US005142323A

United States Patent [19]

Iwamoto

[11] Patent Number: 5,142,323

[45] Date of Patent: Aug. 25, 1992

[54] PAPER FEED CONTROL METHOD FOR A COPIER

[75] Inventor: Minou Iwamoto, Yokohama, Japan

[73] Assignee: Ricoh Company, Ltd., Tokyo, Japan

[21] Appl. No.: 321,839

[22] Filed: Mar. 10, 1989

[30] Foreign Application Priority Data

May 13, 1988 [JP] Japan ..... 63-116739
Jul. 4, 1988 [JP] Japan ..... 63-165063
Jan. 9, 1989 [JP] Japan ..... 1-2328

[51] Int. Cl.[5] ..... G03G 21/00

[52] U.S. Cl. ..... 355/206; 271/3; 355/309

[58] Field of Search ..... 355/230, 308, 309, 320, 355/206, 208; 271/3, 3.1, 10

[56] References Cited

U.S. PATENT DOCUMENTS 3,944,794 3/1976 Reehil et al. ..... 355/309 X
4,058,815 11/1977 Warner et al. ..... 355/308
4,332,462 6/1982 Yagasaki et al. ..... 355/309
4,937,634 6/1990 Hirabayashi et al. ..... 355/309

*Primary Examiner*—Fred L. Braun

[57] ABSTRACT

A copier with an automatic document feeder (ADF) selectively feeds a document to a predetermined position on a glass platen by the ADF at two different timings: a first timing for feeding a paper sheet after confirming that the document has not been misfed and a second timing for feeding a paper sheet immediately without determining whether or not the document has been misfed. A paper sheet associated with the first document is fed at the first timing while paper sheets associated with the second and successive documents are fed at the second timing. A paper sheet which has undergone a copying operation once and which is on an intermediate tray of the copier is refed from the tray at the first timing for another copying operation. When the document is misfed, predetermined processing is executed by determining that a paper sheet associated with that document is unavailable.

22 Claims, 41 Drawing Sheets

PAPER FEED CONTROL METHOD FOR A COPIER

BACKGROUND OF THE INVENTION

The present invention relates to a method of controlling the feed of paper sheets in a copier of the type having an automatic document feeder (ADF).

An ADF is a common equipment with many modern copiers and is provided on a glass platen for copying multiple documents efficiently. A copier with an ADF may be so constructed as to start feeding a paper sheet from a paper tray or similar storage immediately in parallel with the feed of a document by the ADF, thereby eliminating the loss of time ascribable to a paper feed waiting time to a significantly reduce the overall copying time. In practice, however, a copier with an ADF often encounters misfeed of a document and therefore cannot be entirely freed from jams due to the misfeed. If a paper sheet has already been fed from a tray or the like when a misfeed of a document occurs, a reproduction of the document will be locally or entirely missed out on the paper sheet resulting in a copy which is practically unavailable, i.e. waste copy. More specifically, since various units adapted for a sequence of copying processes such as charging, exposing, developing, transferring and fixing processes are not deactivated even when a document has been misfed and the feed of a paper sheet has begun, the copying processes are effected with the paper sheet wastefully. This brings about a problem that a paper counter associated with the paper tray, for example, counts up even such a waste copy. Another problem is that the waste copy is distributed to a predetermined bin of a sorter together with acceptable copies, rendering handling of the resulting copies troublesome. Furthermore, when a two-sided copy mode is selected, the waste copy is transported to an intermediate or two-side tray and therefore also results in the need for troublesome handling.

In light of this, there has been proposed a copier the paper feed timing of which is controlled such that whether or not a document misfeed has occurred in an ADF is determined and, only if it has not occurred, a paper sheet is fed from a paper tray. This kind of control method, however, wastes time in awaiting the decision as to the document feed condition and therefore increases the overall copying time. Such a waste of time is critical especially when a great number of documents are continuously copied.

SUMMARY OF THE INVENTION

It is therefore an object of the present invention to provide a paper feed control method for a copier which, when an ADF is used to automatically transport a document to a glass platen and set it in a predetermined position, minimizes the number of waste copies while decreasing the copying time by a significant degree.

It is another object of the present invention to provide a generally improved paper feed control method for a copier.

In accordance with the present invention, in a paper feed control method for a copier which uses an ADF for feeding and transporting a document to a glass platen and setting the document in a predetermined position on the glass platen, a paper sheet is fed from a paper feeding section simultaneously with the feed of the document from the ADF and, when the document associated with the paper sheet is misfed, predetermined processing is executed by determining that the paper sheet is unavailable.

Further, in accordance with the present invention, in a paper feed control method for a copier which uses an ADF for feeding and transporting a document to a predetermined position on a glass platen and causes a paper feeding section to feed a paper sheet to copy the document, a first paper feed timing and a second paper feed timing are predetermined for causing the paper feeding section to feed the paper sheet after confirming that the document has not been misfed by the ADF and for causing the paper feeding section to feed the paper immediately without confirming whether or not the document has been misfed, respectively, and the paper sheet is fed at the first paper feed timing for the first document to be copied and at the second paper feed timing for the second and successive documents to be copied.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
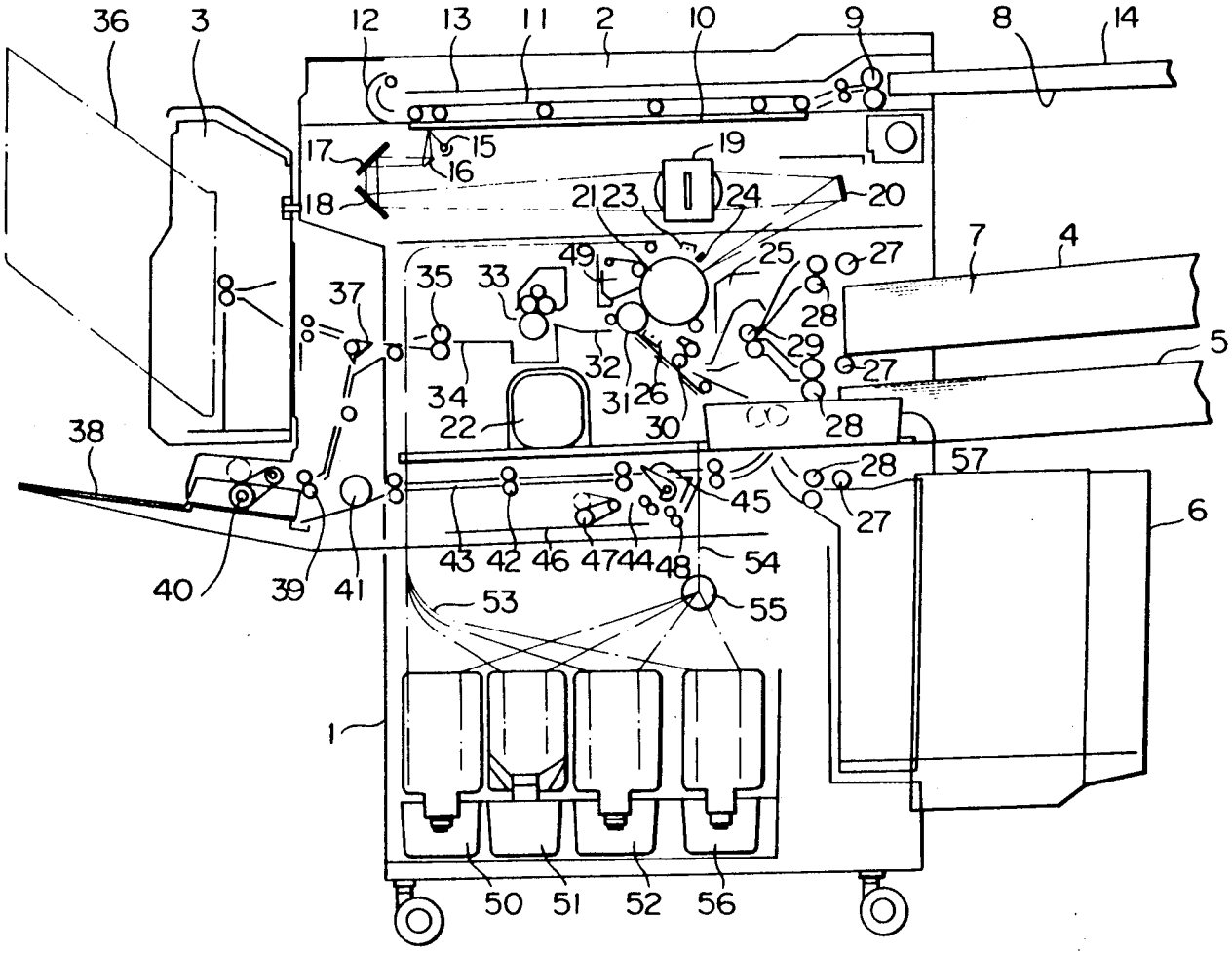
FIG. 1 is a schematic section showing a copier to which the present invention is applied.

Referring to FIG. 1 of the drawings, a monocolor copier to which the present invention is applied is shown. An ADF 2 is mounted atop the body 1 of the copier while a sorter 3 is mounted on one side of the copier body 1 where copies will be discharged. Two paper cassettes 4 and 5 and a paper tray 6 which may be loaded with a great amount of paper sheets are mounted on the other side or paper feed side of the copier body 1. Paper sheets may be selectively fed from any of the cassettes 4 and 5 and tray 6.

The ADF 2 includes a document table 8 to be loaded with a stack of documents 14, a feed roller pair 9, a belt 11 located above a glass platen 10 for transporting the documents 14, an outlet turn guide 12, and a discharge tray 13. Each of the documents 14 stacked on the table 8 is automatically fed by the feed roller pair 9 and transported by the belt 11 to the glass platen 10 and then stopped at a predetermined position on the glass platen 10 to be scanned for imagewise exposure. After the document 14 has been scanned, the belt 11 is driven again to drive the document 14 out to the discharge tray 13. Such a sequence of steps is repeated with the other documents 14 also. The ADF 2 is bodily rotatable or openable about one side thereof away from the glass platen 10. This allows a comparatively thin document or a document which should not be automatically fed to be laid on the glass platen by hand by opening the ADF 2, then the ADF 2 functioning as a cover plate.

The copier body 1 accommodates optics for scanning the document 14 which is laid on the glass platen either automatically or manually. First, the document is illuminated by a lamp 15. An imagewise reflection from the document 14 is routed through first to third mirrors 16, 17 and 18, a lens unit 19 and a fourth mirror 20 to be focused on the surface of a photoconductive element in the form of a drum 21. The lamp 15 and first mirror 16 are mounted on a first carriage (not shown) which is disposed below the glass platen 10 and is movable at a constant speed from the left to the right as viewed in FIG. 1. The second and third mirrors 17 and 18 are mounted on a second carriage (not shown) which is movable in the same direction but at half the speed of the first carriage. The drum 21 is rotated clockwise as viewed in the figure by a main motor 22 through a gearing (not shown). Various members are arranged around the drum 21 to effect electrophotographic processes. Specifically, a main charger 23 uniformly charges the surface of the drum 21 to a predetermined polarity. The charged surface of the drum 21 is driven toward the optics by way of a fractioned erase unit 24 so as to be exposed to the imagewise reflection from the document 14. The resulting electrostatic latent image formed on the drum 21 is developed by a developing device 25 to become a visible image. The visible image is fed to a transfer station where a transfer charger 26 is located.

A paper sheet 7 is fed from any of the cassettes 4 and 5 and paper tray 6 by an associated one of feed rollers 27 and then driven by transport roller pairs 28 and 29 to a register roller 30. The register roller 30 further drives the paper sheet 7 at a predetermined timing to the transfer station along a paper guide. At the transfer station, the transfer charger 26 is operated to transfer the visible image on the drum 21 to the paper sheet 7. The paper sheet 7 coming out of the transfer station is separated from the drum 21 by a separating unit 31 and then guided by a paper guide 32 to a fixing device 33. After the image on the paper sheet 7 has been fixed by a heating element of the fixing unit 33, the paper sheet or copy 7 is driven out of the copier body 1 along a paper guide 34 by a discharge roller pair 35. In a sorter mode, the copy 7 will be distributed to a certain bin 36 of the sorter 3.

In a two-sided copy mode or a combination copy mode, a single paper sheet undergoes two consecutive copying operations. Specifically, the paper sheet 7 moved past the discharge roller pair 35, is directed downward by a selector 37 and then driven by a roller pair 39 onto an intermediate tray 38 face up. Thereafter, the paper sheet 7 is sequentially transported by a pick-up roller 40, a refeed roller 41 and a transport roller pair 42 along a second path 43 to the register roller 30. Again, the register roller 30 drives this paper sheet 7 at a predetermined timing toward the transfer station. In the two-sided copy mode, the paper sheet 7 awaits a refeed on the intermediate tray 38 while being laid face up on the tray 38. Hence, when such a paper sheet 7 is directly turned from the second path 43 to the transfer charger 26, its back or non-imaged surface faces the drum 21 and is therefore ready to receive an image from the drum 21. On the other hand, in the combination copy mode such as an undercolor mode which allows an image to be copied on a single color copy, it is necessary to transfer images twice onto the same side of the paper sheet 7. To implement this kind of mode, a reversing device 44 is located on the second path 43 and includes a selector pawl 45. The reference numerals 46, 47 and 48 designate a reversal tray, a pick-up roller and a refeed roller pair, respectively.

After the transfer of a visible image, the surface of the drum 21 is cleaned by a cleaning unit 49 and then uniformly charged by the main charger 23 to repeat the procedure described above.

Reservoirs 50, 51 and 52 are disposed in a lower part of the copier body 1 and filled with red, green and blue liquid developers, respectively. The reservoirs 50, 51 and 52 are individually extended to the drum 21 by independent conduits so that the liquid developers may be circulated between the drum 21 and the reservoirs. Conduitworks for the supply and collection of the developers are generally designated by the reference numerals 53 and 54, respectively. The collected developers are distributed to the individual reservoirs at a distributing section 55. Designated by the reference numeral 56 is a reservoir which stores cleaning liquid. Further, a reservoir 57 stores black toner liquid which will be used most frequently and is positioned in the vicinity of the drum 21.

Figure 2:
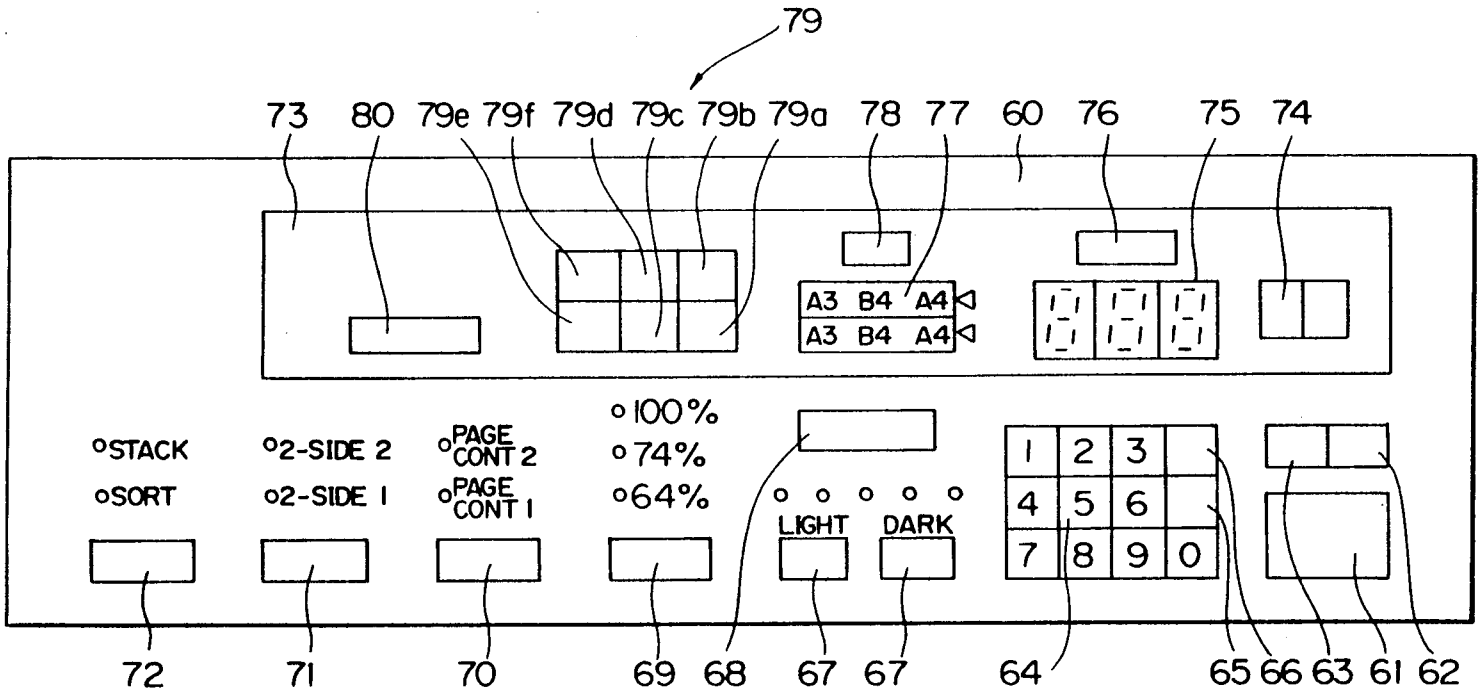
FIG. 2 is a schematic plan view of an operation board provide on the copier of FIG. 1.

Referring to FIG. 2, an operation and display board 60 provided on the copier is shown. The operation and display board 60 is provided with a power switch (not shown) and other various key switches or keys inclusive of ordinary mode keys. Typical of such keys are a print key 61, an interrupt key 62, a mode clear key 63, numeral keys 64, a clear stop key 65, and a number set key 66. Also provided on the board 60 are density keys 67, a paper select key 68, a magnify key 69, a continuous page copy key 70, a two-sided copy key 71, and a sorter key 72 which are accessible for entering various modes and functions. The density keys 67 automatically set up predetermined copy density or may be operated to select a desired copy density. The magnify key 69 cyclically sets up predetermined magnifications of 100%, 74% and 64% every time it is operated. The continuous page copy key 70 is operable to select either one of continuous page 2 and continuous page 1. The two-sided copy key 71 sets up either one of two-sided 2 or two-sided 1. The sorter key 72 is accessible for selecting a stack mode or a sorter mode. A combination copy key and other various kinds of keys are provided on the operation and display board 60 although not shown in the drawing.

A display section 73 on the operation and display board 60 includes a document number display 74, a copy number display 75, a job-in-process display 76, a paper selection display 77, and a paper end display 78. The display section 73 further includes failure displays, generally 79, such as a serviceman call display 79*a*, a toner end display 79*b*, a door open display 79*c*, a developer end display 79*d*, a paper jam display 79*e*, and a document jam display 79*f*. The reference numeral 80 designates a second side mode display.

Figure 3:
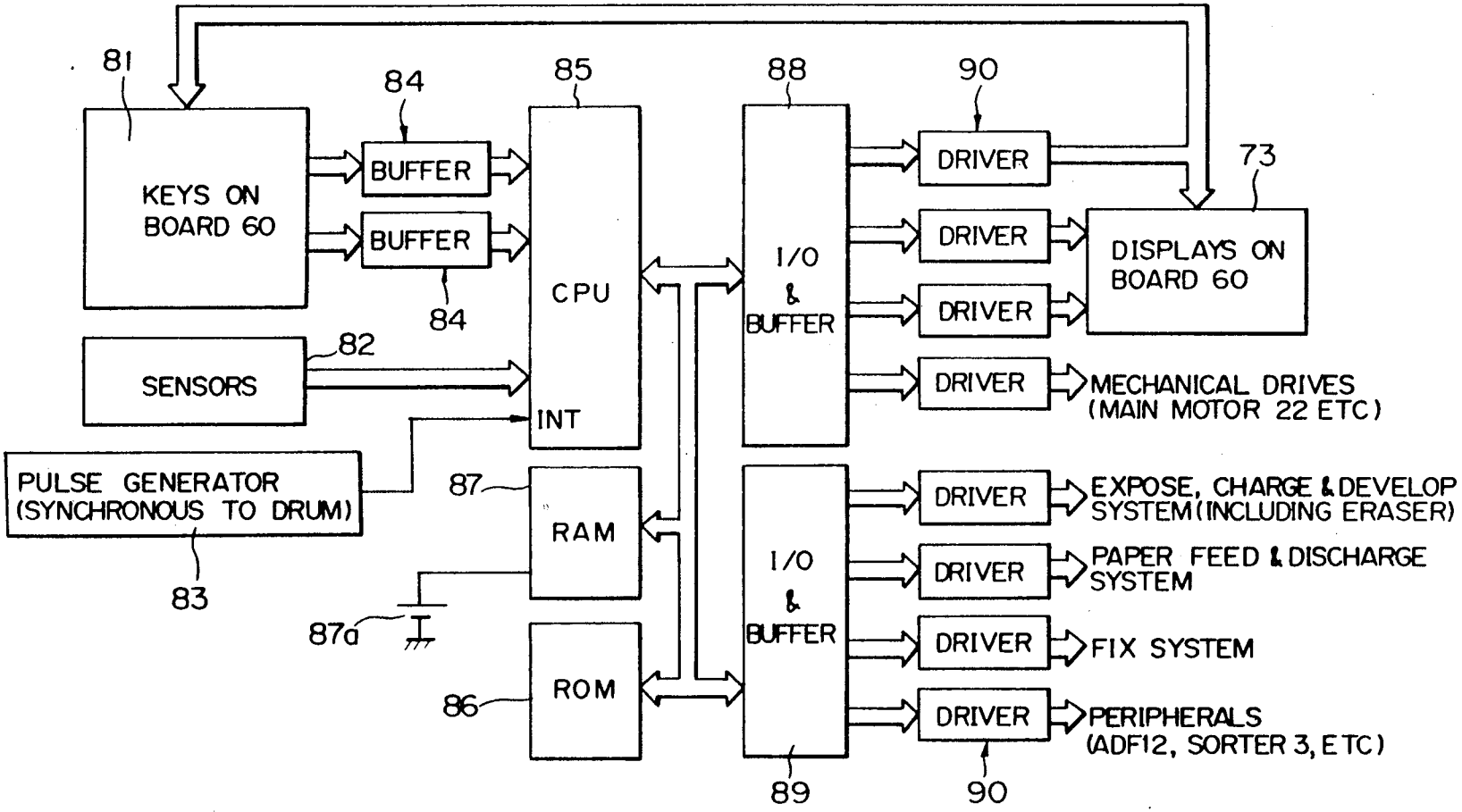
FIG. 3 is a block diagram schematically showing a control system.

FIG. 3 schematically shows a control system installed in the copier having the above construction. As shown, a central processing unit (CPU) 85 for controlling the entire copier is connected to a group of key switches 81 which are operated by the various keys on the operation and display board 60, sensors (e.g. paper sensor and jam sensor) 82 responsive to various conditions inside the machine, a pulse generator 83 for generating timing pulses synchronous with the drum 21, etc., via various buffers 84. A read only memory (ROM) 86, a random access memory (RAM) 87 and input/output (I/O) port buffers 88 and 89 are connected to the CPU 85 by an address bus, a control bus, and a data bus. Loads including the display section (elements) 73 on the operation and display board 60, driving mechanisms (e.g. main motor 22), exposing, charging and developing devices, paper feed and discharge mechanisms, fixing device, and ADF 2, sorter 3 and other peripheral equipments are connected to the I/O port buffers 88 and 89 via drivers 90. Backed up by a battery 87*a*, the RAM 87 causes a part thereof to play the role of a non-volatile memory.

Figure 4:
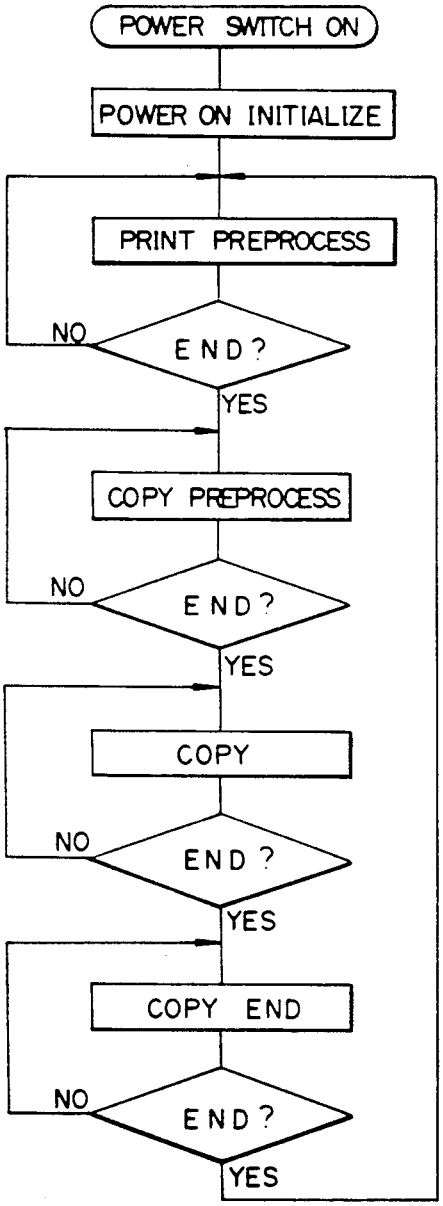
FIG. 4 is a flowchart representative of a basic control procedure.

Referring to FIG. 4, the basic operation of the control system shown in FIG. 3 is shown in a flowchart. When the power switch of the copier is turned on, the control system sequentially executes a POWER ON INITIALIZE routine, PRINT PREPROCESS routine, COPY PREPROCESS routine, and actual COPY routine. Upon completion of the COPY routine, the program advances to COPY END processing to prepare for the next copying operation or waits while repeating the COPY END processing.

Figure 5:
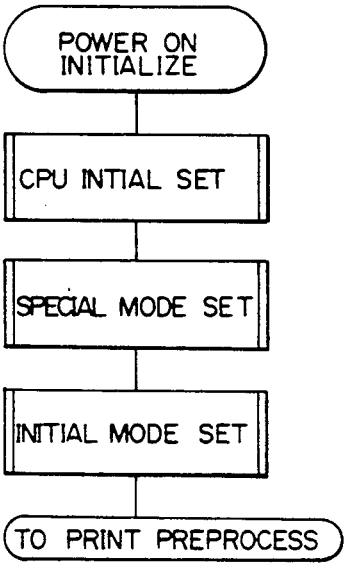
FIG. 5 is a flowchart showing a POWER ON INITIALIZE routine.
Figure 6:
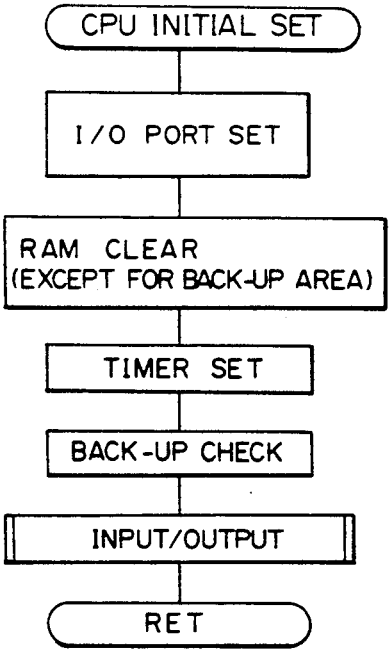
FIG. 6 is a flowchart showing a CPU INITIAL SET routine.

As shown in FIG. 5, the POWER ON INITIALIZE routine consists of CPU INITIAL SET processing for initializing the CPU 85, selective SPECIAL MODE SET processing, and INITIAL MODE SET processing. As shown in FIG. 6, in the CPU INITIAL SET processing, input and output ports are set, the RAM 87 is cleared (except for the back-up area), various timers are set, and the back-up is checked. This is followed by INPUT/OUTPUT processing.

The SPECIAL MODE SET processing is a selective procedure and is a characteristic feature of the illustrative embodiment. This processing allows one to change a part of the standard copy modes of the copier as desired so that the changed mode may be set as one of the standard operation modes. The INITIAL MODE SET processing is adapted to restore the copier to the standard operation modes. The SPECIAL MODE SET processing will be described hereinafter with reference also made to FIGS. 8 to 13.

Figure 7:
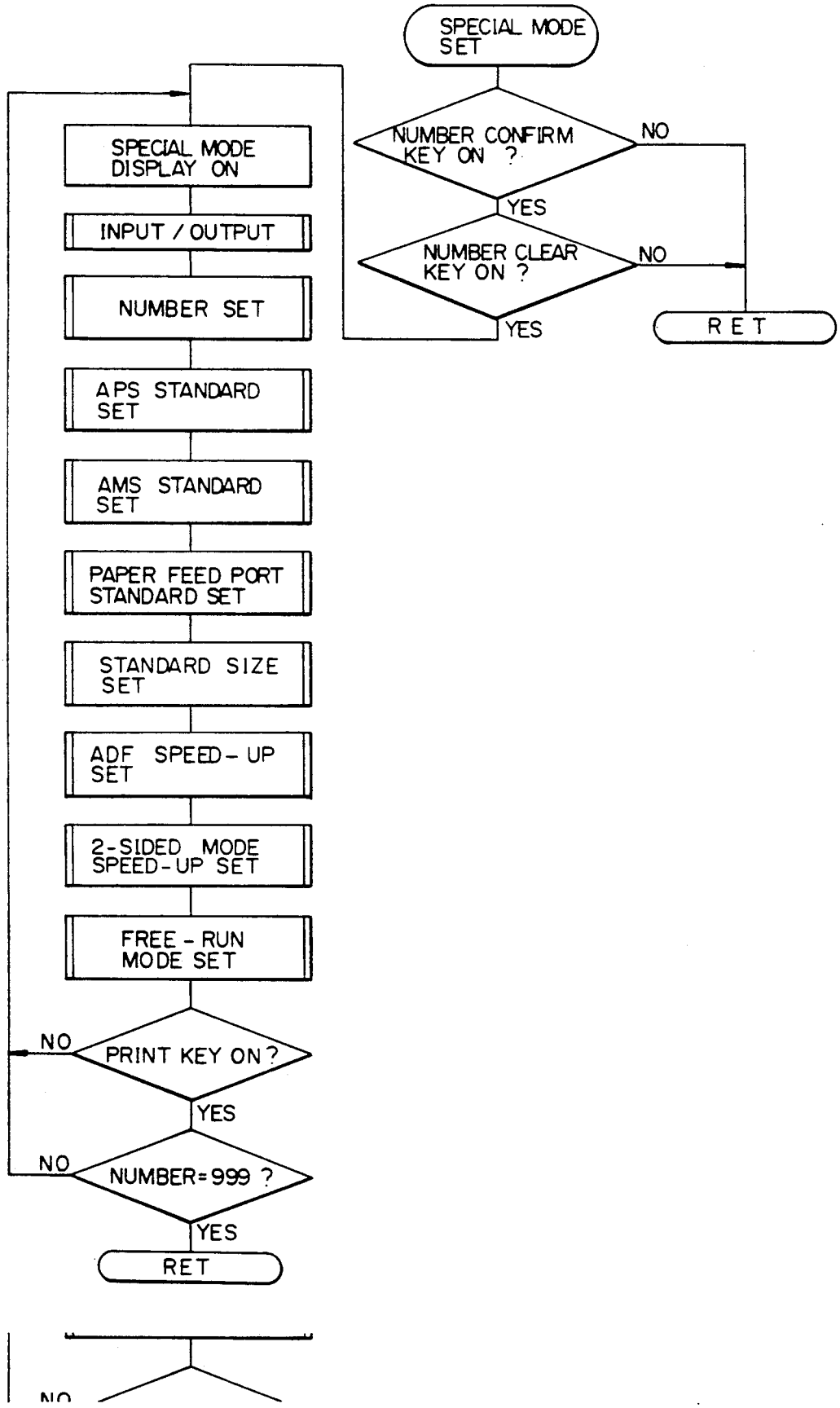
FIG. 7 is a flowchart showing a SPECIAL MODE SET routine.

The selective SPECIAL MODE SET routine requires an operator's intentional manipulations so as to prevent the standard operation modes from being carelessly changed. In the illustrative embodiment, this particular routine begins when the operator turns on the power switch of the copier while pressing the number check key 66 and a number clear key (clear stop key 65) on the operation and display board 60. As the routine begins, an indicator representative of a special mode is turned on. Specifically, the standard modes may be changed by any of a STANDARD APS (Automatic Paper Select) SET subroutine, a STANDARD AMS (Automatic Magnification Select) SET subroutine, a STANDARD PAPER FEED PORT SET subroutine, an ADF SPEED-UP subroutine, and a FREE-RUN MODE SET subroutine, as shown in FIG. 7. Any of these subroutines is selected by INPUT/OUTPUT processing and NUMBER ENTER processing. To end the SPECIAL MODE SET routine, a numerical value of "999" is entered on the numeral keys 64 and the print key 61 is pressed or the power switch is turned off. When the print key 61 is pressed after the entry of the number "999", the program immediately advances to the following INITIAL MODE SET routine so that any new mode selected by the SPECIAL MODE SET routine is set as a part of the standard modes. On the other hand, when the power switch is turned off, the newly selected mode is stored in the back-up area of the RAM 87 and, when the power switch is turned on again, it will be set as a part of the standard modes.

Figure 8:
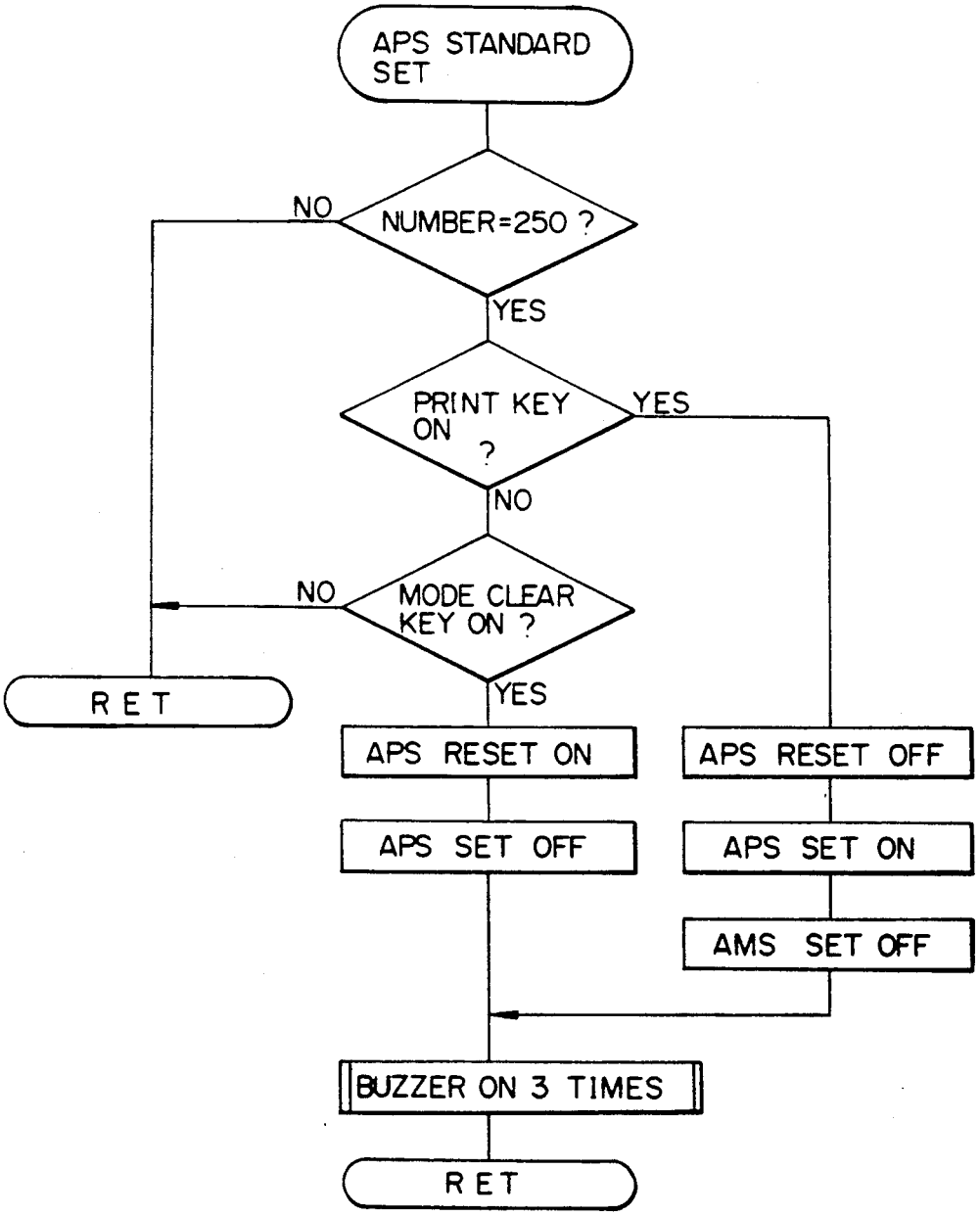
FIGS. 8 to 13 are flowcharts showing various subroutines included in the routine shown in FIG. 7.

FIG. 8 shows the STANDARD APS SET subroutine which is adapted to determine whether or not to set an automatic size selection or APS mode as one of the standard operation modes, i.e., those modes which automatically restore themselves in the initial mode after the turn-on of the power switch or upon the lapse of a predetermined period of time after copying operations. The APS mode is available for automatically selecting paper sheets of a particular size on the basis of the size of the documents and the magnification. To select the APS mode as a standard operation mode, "250" is entered on the numeral keys 64 and then the print key 61 is pressed, whereby an APS set flag is set. On the other hand, when the mode clear key 63 is pressed after the entry of "250", an APS reset flag is set to cancel the APS mode. The APS set flag and the APS reset flag are stored in the back-up area of the RAM 87 and held therein even when the power switch is turned off. Hence, as the power switch is turned on afterwards, whether or not to select the APS mode as one of the standard operation modes is determined in the event of INITIAL MODE SET of the POWER ON INITIALIZE processing by referencing the those flags. The end of setting is notified by energizing a buzzer three times.

Figure 9:
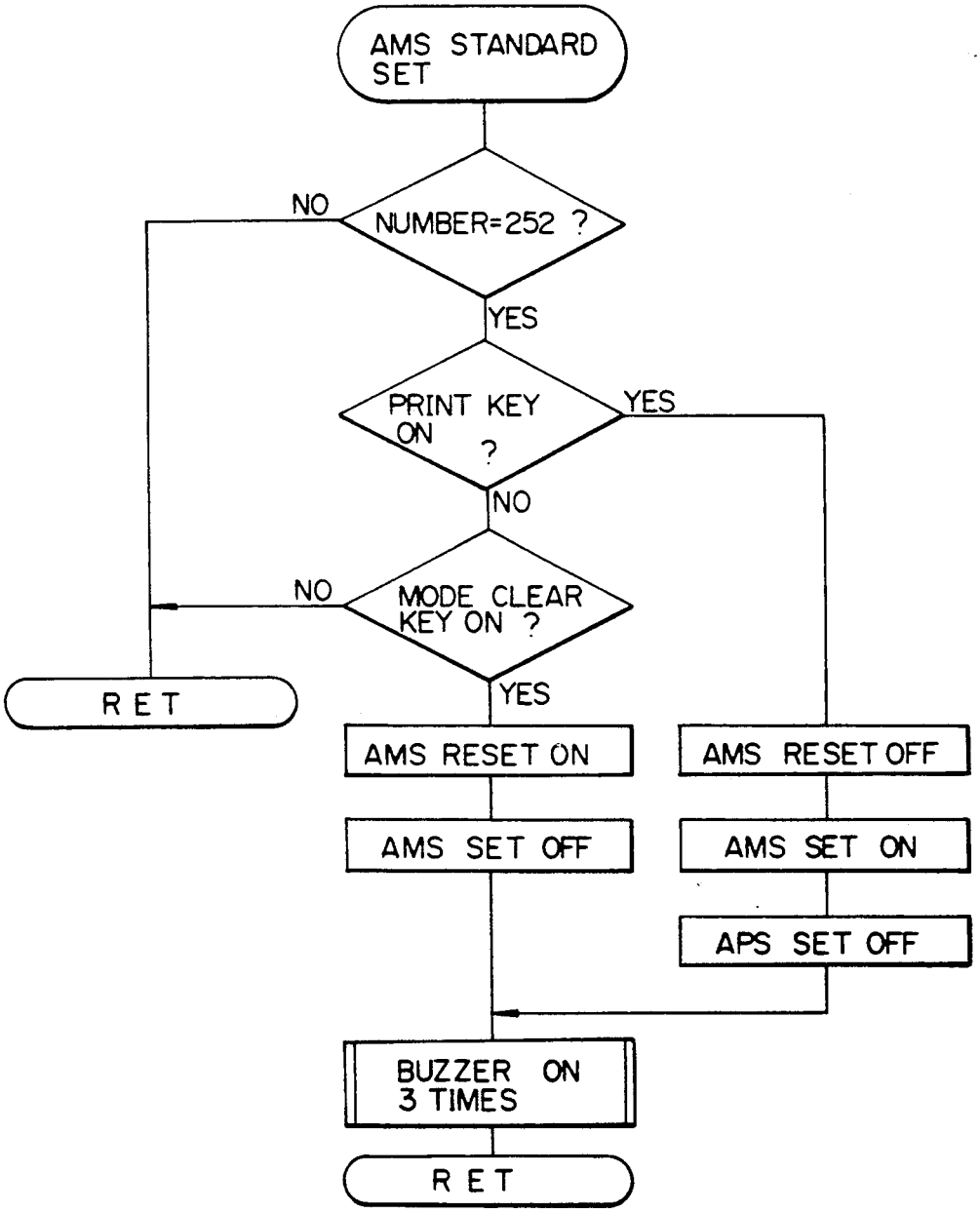

FIG. 9 shows the AMS STANDARD SET subroutine which is to determine whether or not to select an automatic magnification selection or AMS mode as one of the standard operation modes. In the AMS mode, a magnification is automatically set up on the basis of the size of the documents and the size of the paper sheets.

To select the AMS mode as a standard operation mode, "252" is entered on the numeral keys 64 and then the print key 61 is pressed, whereby an AMS set flag is set. On the other hand, when the mode clear key 63 is pressed after the entry of "252", an AMS reset flag is set to cancel the AMS mode. Again, the AMS set flag and the AMS reset flag are stored in the back-up area of the RAM 87.

Figure 10:
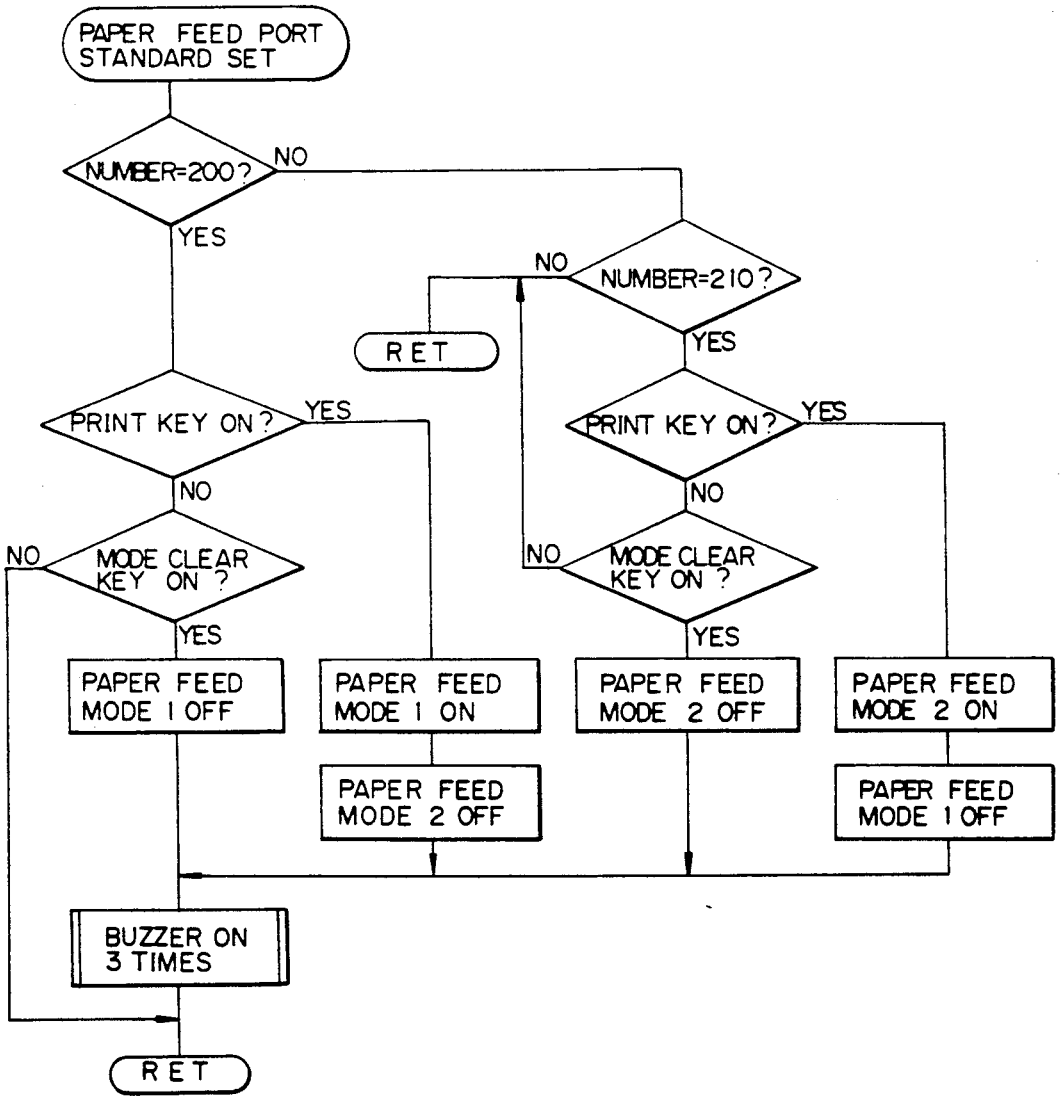

FIG. 10 shows the PAPER FEED PORT STANDARD SET subroutine. This subroutine is adapted to select one of the cassettes 4 and 5 and tray 6 from which paper sheets should be fed out. The cassette 4, cassette 5 and tray 6 correspond to a first paper feed port (paper feed mode 1), a second paper feed port (paper feed mode 2), and a third paper feed port (paper feed mode 3), respectively. Specifically, when "200" is entered on the numeral keys 64 and then the print key 61 is pressed, a paper feed mode 1 flag is set to select the paper feed from the cassette 4 (first paper feed port) as a standard operation mode. When "210" is entered and then the print key 61 is pressed, a paper feed mode 2 flag is set to select the paper feed from the tray 6 (third paper feed port) as a standard mode. The statuses of such flags are also stored in the back-up area of the RAM 87.

Figure 11:
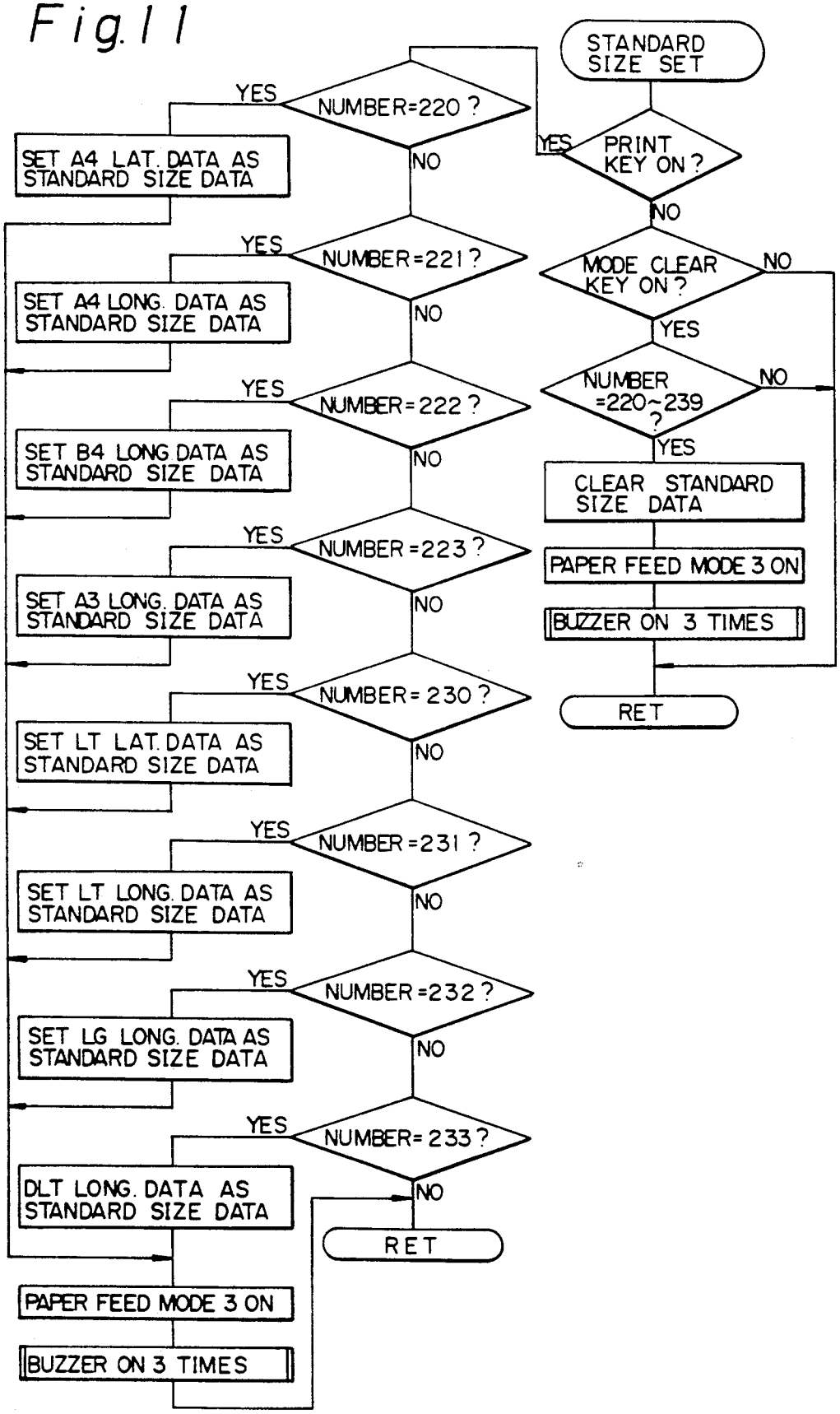

FIG. 11 shows the STANDARD SIZE SET subroutine which allows a preset paper size to be automatically set during standard mode operations. Specifically, when the numeral keys 64 and the print key 61 are operated, size data associated with the entered numerical value are written in a standard size data area. For example, "200" is entered on the numeral keys 64 and then the print key 61 is pressed, size data representative of "format A4" and "lateral" will then be set in the standard size data area. The numerical value may be changed to enter another paper size. Meanwhile, the paper feed mode 3 flag is reset to prevent paper sheets from being fed from the tray 3 (third paper feed port). The standard size data and paper feed mode 3 flag are stored in the back-up area. Hence, in the INITIAL MODE SET routine which begins upon the subsequent turn-on of the power switch, a PAPER FEED PORT SET subroutine is called up as will be described and, if the entered number is "220" as stated above, the paper feed port associated with the paper sheets 7 of format A4 and lateral position is selected.

Figure 12:
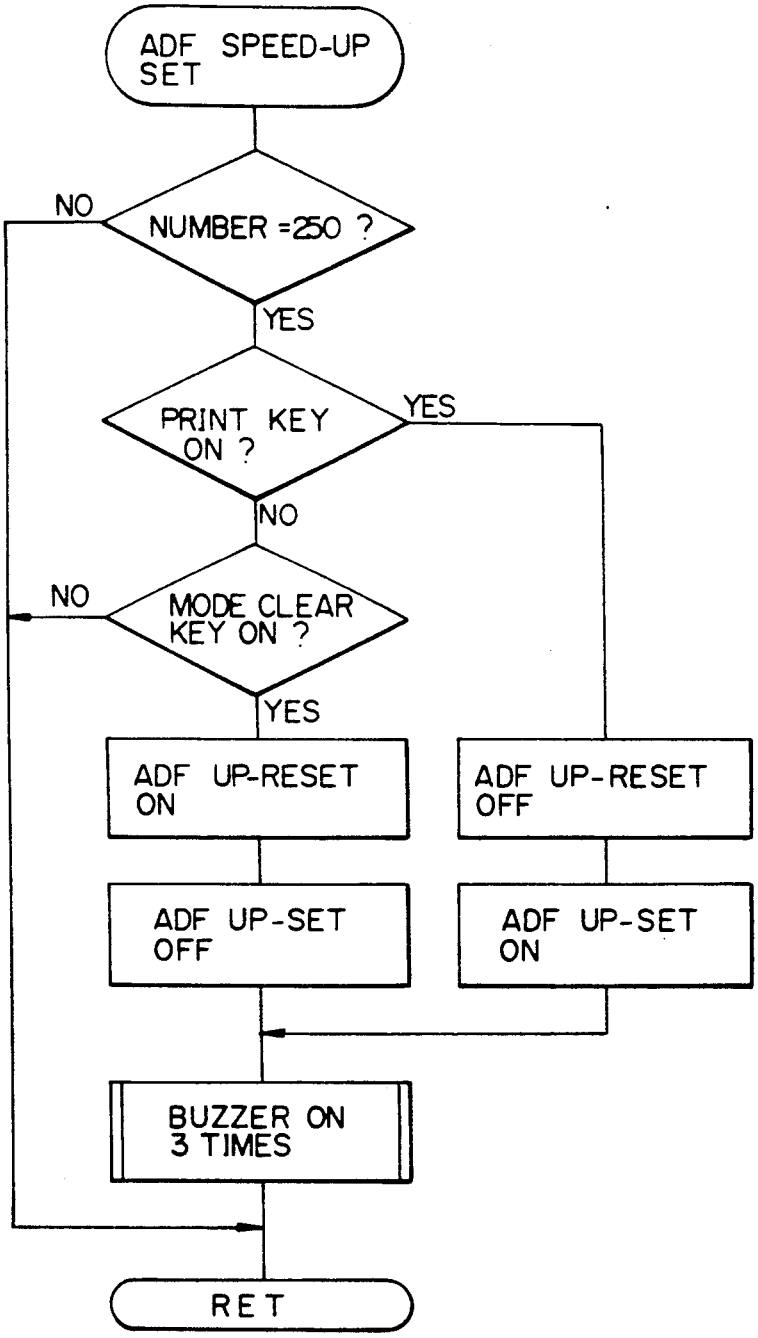

Referring to FIG. 12, the ADF SPEED-UP SET subroutine is shown in detail. In the illustrative embodiments, when the copier is operated with the ADF 2, two different paper feed control modes are available: a mode based on a first paper feed timing which is such that the copier feeds the paper sheet 7 after confirming that the document 14 has been successfully fed to the predetermined position on the glass platen 10 by the ADF 10 without jamming the path (paper feed confirmation system), and a mode based on a second paper feed timing which is such that the copier immediately feeds the paper sheet 7 at a predetermined timing by omitting such confirmation (speed-up system). The ADF SPEED-UP SET subroutine is used to select one of the two different paper feed control modes as a standard mode. The first paper feed timing prevents the paper sheet 7 from being fed when the ADF 2 encounters a misfeed or jam, thereby eliminating wasteful copying operations. A drawback with the first paper feed timing is that, when a single copy should be produced with each of a great number of documents, the copying time is somewhat increased. On the other hand, the second paper feed timing allows the paper sheet 7 to be fed in parallel with the transport of the document 14 and thereby reduces the waiting time, i.e., overall copying time when, for example, a great number of documents should be reproduced. This, however, results in a waste copy because the paper sheet 7 will have already been fed when a misfeed occurs in the ADF 2. The ADF SPEED-UP SET subroutine is provided for selecting either one of the first and second paper feed timings each having an advantage and a disadvantage as stated above. Specifically, when "250" is entered on the numeral keys 64 and then the print key 61 is pressed, an ADF up-set flag is set; when the mode clear key 63 is pressed in place of the print key 61, an ADF up-reset flag is set. Again, these flags are stored in the back-up area. Processing associated with these different settings will be described in detail later.

Figure 13:
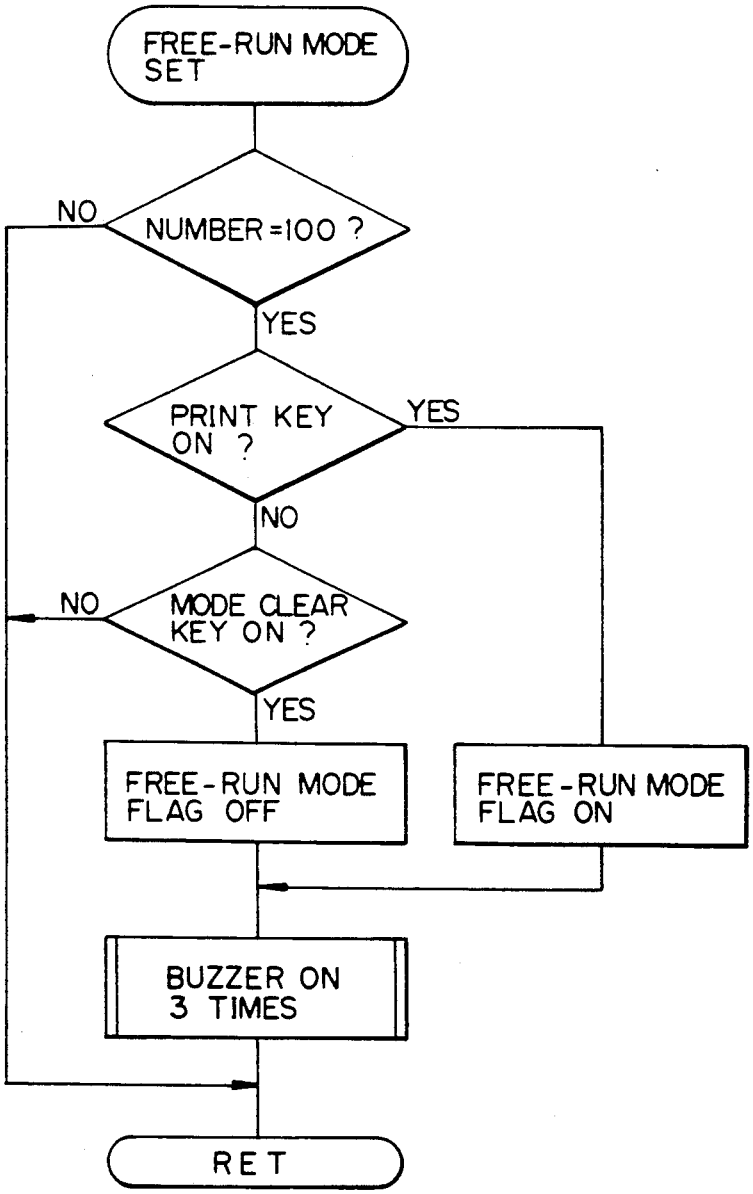

FIG. 13 shows the FREE-RUN MODE SET subroutine. When "100" is entered on the numeral keys 64 and then the print key 64 is pressed, a free run mode flag is set. When the mode clear key 63 is pressed, the free run mode flag is reset. Set/reset data associated with this flag is not stored in the back-up area and therefore is not non-volatile data. More specifically, a free-run mode selected by this subroutine is valid only until the turn-off of the power switch. When the power switch is turned off and then turned on afterwards, the program starts on the SPECIAL MODE SET routine, i.e., the free-run mode is not set up unless the above-mentioned manipulations are performed again. Further, when "999" is entered on the numeral keys 64 and then the print key 61 is pressed to cancel the SPECIAL MODE SET ROUTINE, there can be executed a copying operation in the free-run mode, i.e., a special copying operation in which paper feed and jam detection are inhibited.

Figure 14:
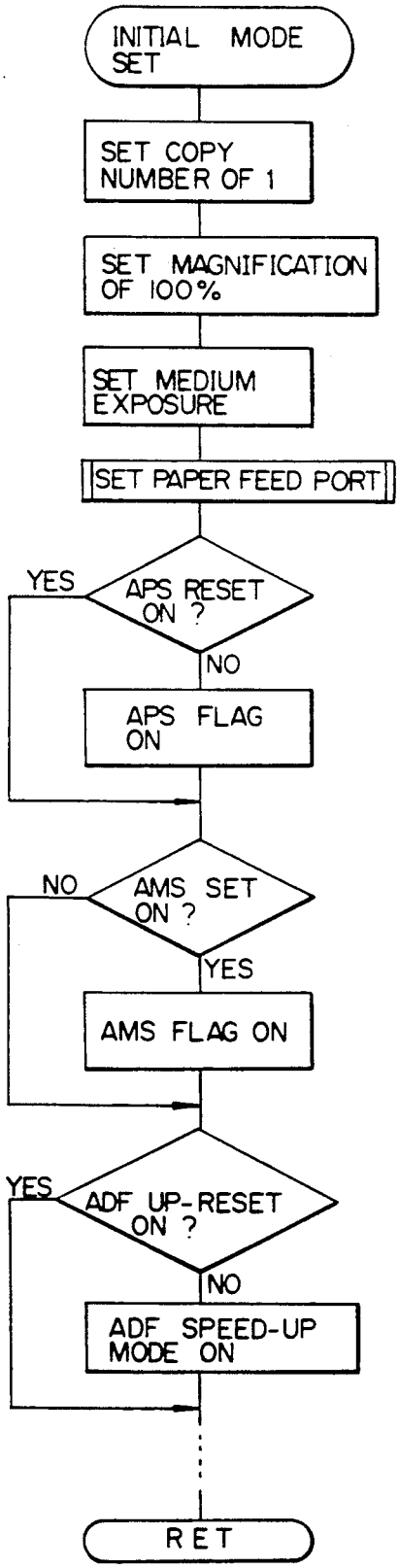
FIG. 14 is a flowchart showing an INITIAL MODE SET routine.

Referring to FIG. 14, there is shown the INITIAL MODE SET routine which is included in the POWER ON INITIALIZE processing and follows the SPECIAL MODE SET routine discussed above. The INITIAL MODE SET routine begins with setting a copy number of 1, a magnification of 100%, and a medium amount of exposure (which are the standard operation mode data), and selecting any of the paper feed ports by the procedure shown in FIG. 15. Then, the program sets the APS mode, AMS mode and ADF speed-up mode. If the APS reset flag is reset, the ASP mode is set as one of the standard operation modes by the procedure of FIG. 8. More specifically, the APS mode is selected as one of the standard operation modes unless the APS reset flag is set by the procedure of FIG. 8 (in practice, this kind of copier is conditioned for the APS mode at the forwarding stage). Likewise, the AMS mode is set if the AMS set flag is set. More specifically, the AMS set flag remains reset and therefore the AMS mode is not set unless the AMS set flag is set by the procedure of FIG. 9 (in fact, the AMS mode of this kind of copier is deactivated at the forwarding stage). Further, the ADF SPEED-UP mode is selected as a standard operation mode if the ADF up-reset flag is reset, i.e., it is set up at all times unless the ADF up-set flag is set by the steps of FIG. 11 (at the forwarding stage, the ADF speed-up mode is the standard operation mode).

Figure 15:
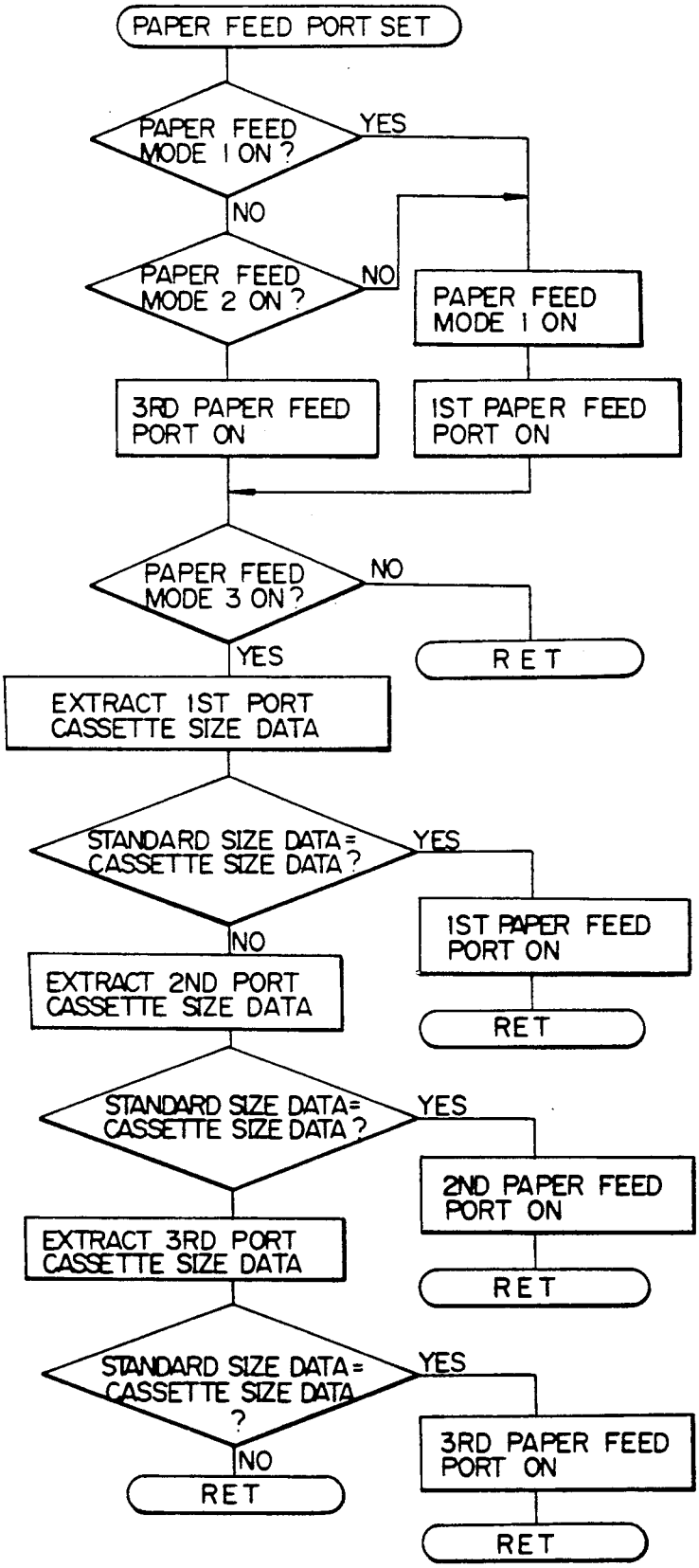
FIG. 15 is a flowchart showing a PAPER FEED PORT SET routine.

FIG. 15 shows the PAPER FEED PORT SET routine included in the INITIAL MODE SET processing in detail. The copier to which the present invention is applied is forwarded with the paper feed timing 1 which causes the paper sheet 7 to be fed from the first paper feed port (cassette 4) being selected as a standard operation mode. Hence, the first paper feed port is the standard port so long as nothing is changed in the sequence of steps of FIG. 9 which is included in the SPECIAL MODE SET routine. On the other hand, when the paper feed timing 2 is selected by the procedure of FIG. 10, paper feed from the third paper feed port (tray 6) is selected as a standard operation mode. When the standard size is chosen by the SPECIAL MODE SET routine, one of the paper feed ports which is loaded with paper sheets of a specified size is selected with priority to the above-mentioned paper feed modes 1 and 2. If the paper sheets 7 of a specified size are not present in any of the paper feed ports 4, 5 and 6, one of those ports which is determined by the designated paper feed timing is selected.

Figure 16:
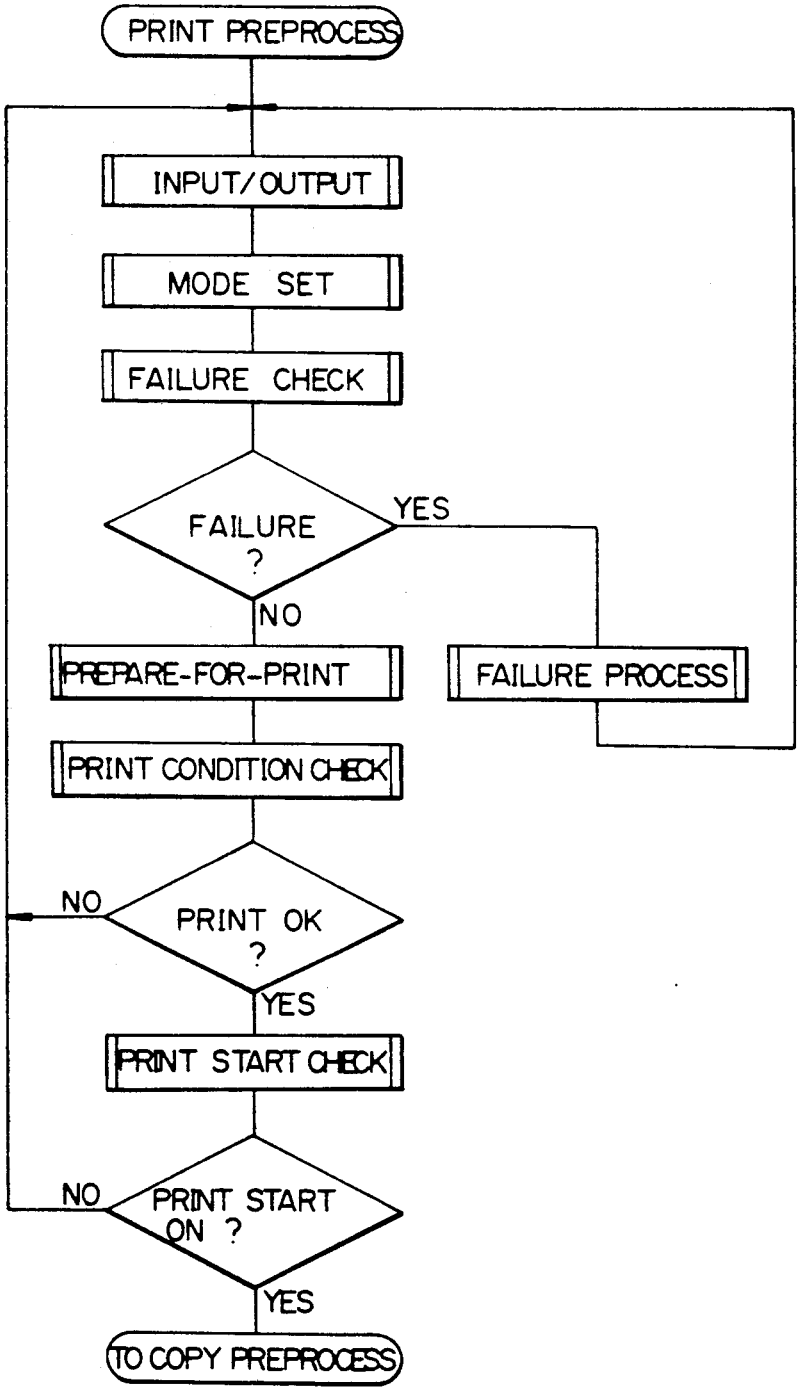
FIG. 16 is a flowchart showing a PRINT PREPROCESS routine.
Figure 17:
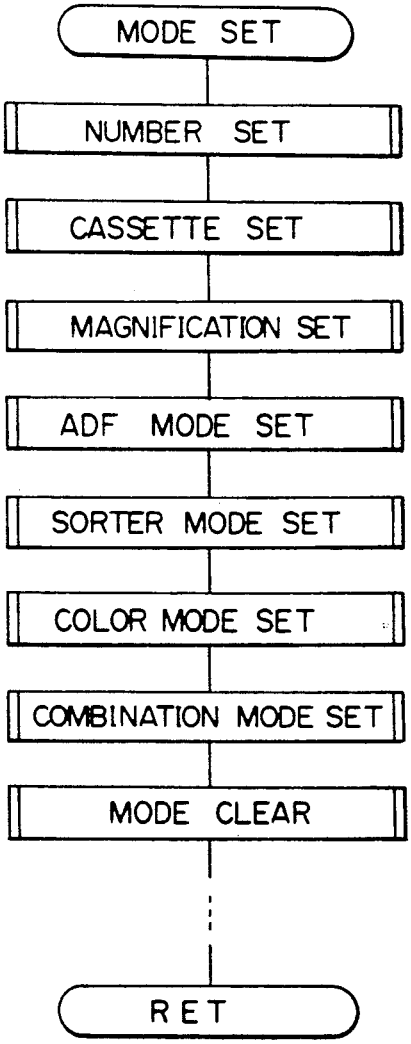
FIGS. 17 to 19 are flowcharts showing various subroutines included in the routine of FIG. 16.
Figure 18:
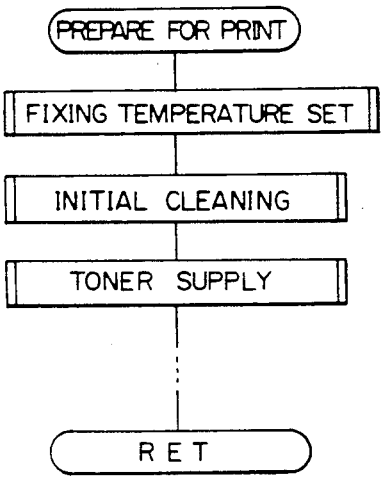
Figure 19:
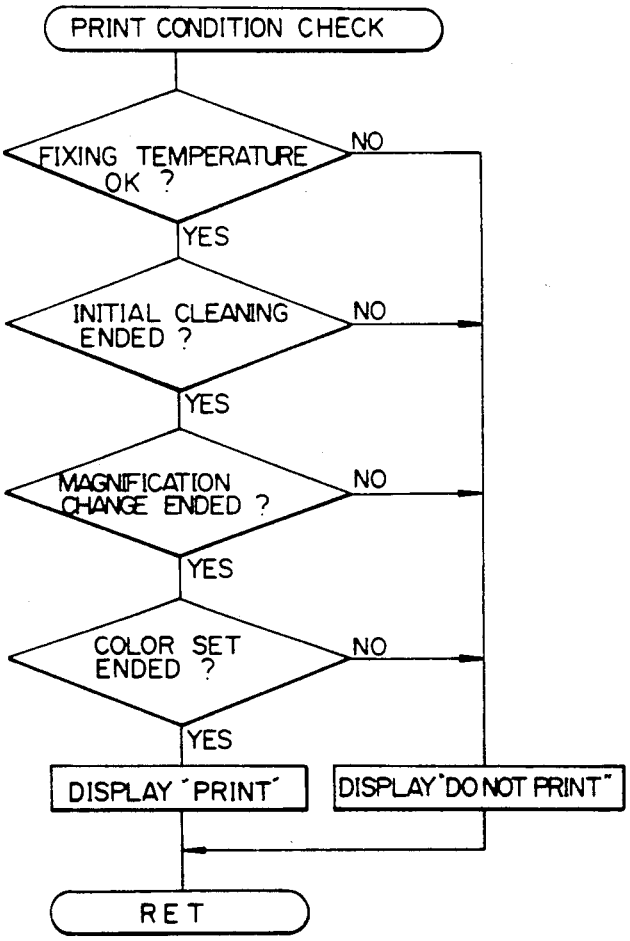

FIG. 16 shows the PRINT PREPROCESS routine included in the basic routine of FIG. 4. This routine mainly consists of a MODE SET subroutine executed by key inputs on the operation and display board 60, a PREPARE-FOR-PRINT subroutine for enabling a copying operation to take place, a PRINT CONDITION CHECK subroutine for determining whether or not a printing operation is allowable, and a PRINT START CHECK subroutine associated with the print key 61 and the like. As shown in FIG. 17, the MODE SET subroutine includes copy number setting, cassette setting, color mode setting, combination mode setting, and mode clearing. As shown in FIG. 18, the PREPARE-FOR-PRINT subroutine includes fixing temperature setting, initial cleaning, and toner supplying. Further, as shown in FIG. 19, the PRINT CONDITION CHECK subroutine includes fixing temperature checking, initial cleaning end checking, magnification change set checking, and color set checking. If the results of all the decisions shown in FIG. 19 are YES, a message such as "PRINT" is displayed and, if even one of them is NO, a message such as "DO NOT PRINT" is displayed.

Figure 20:
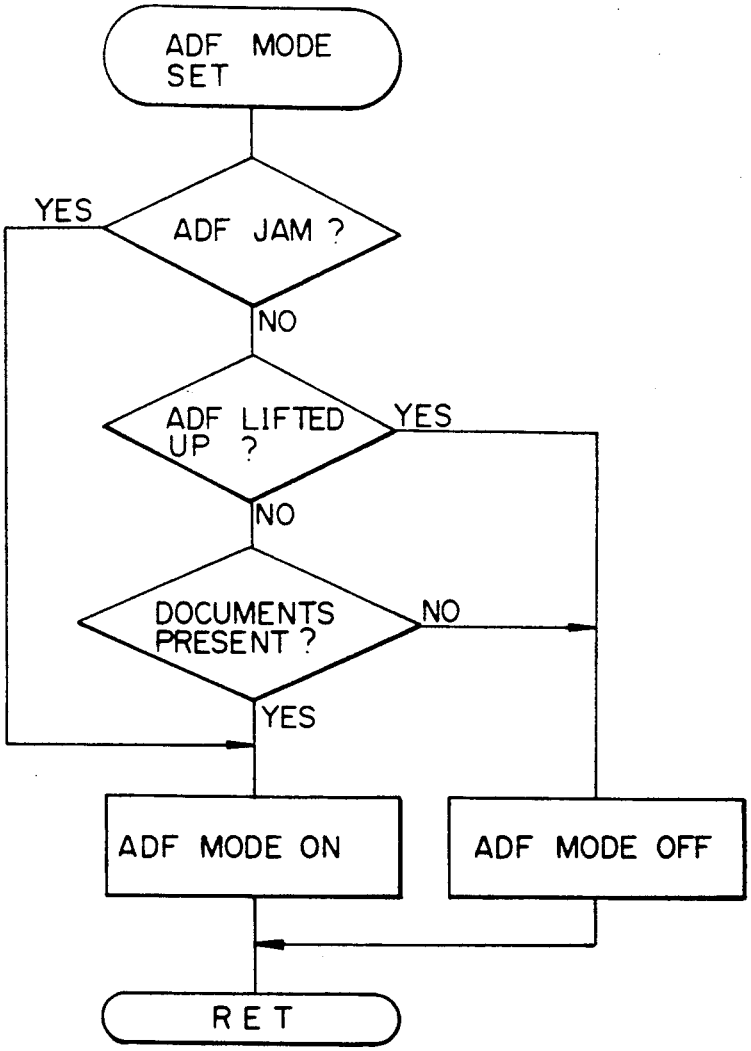
FIG. 20 is a flowchart showing an ADF MODE SET routine.

As shown in FIG. 20, the ADF MODE SET subroutine is such that an ADF mode flag is set to automatically set up the ADF mode on conditions that the documents 14 are stacked on document table of the ADF 2 (as sensed by a sensor), that no document is jamming the ADF 2, and that the ADF 2 is not lifted up.

Figure 21:
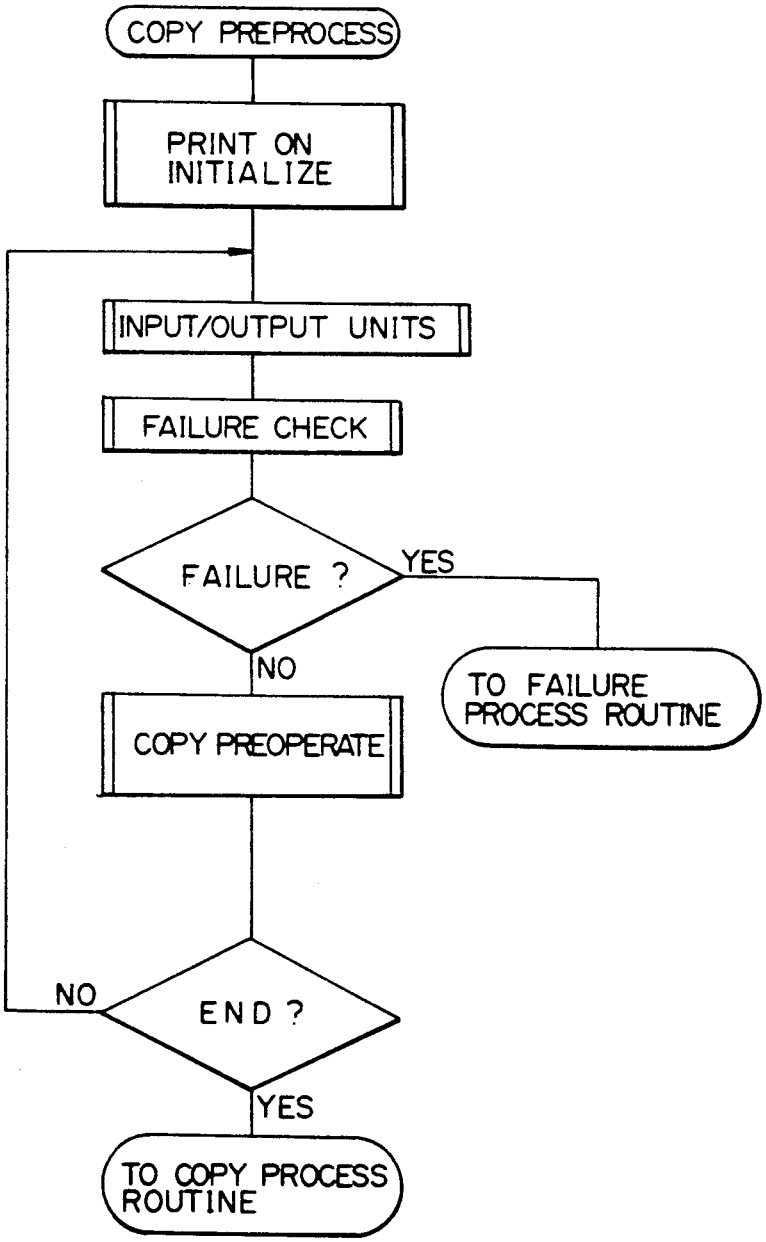
FIG. 21 is a flowchart showing a COPY PREPROCESS routine.
Figure 22:
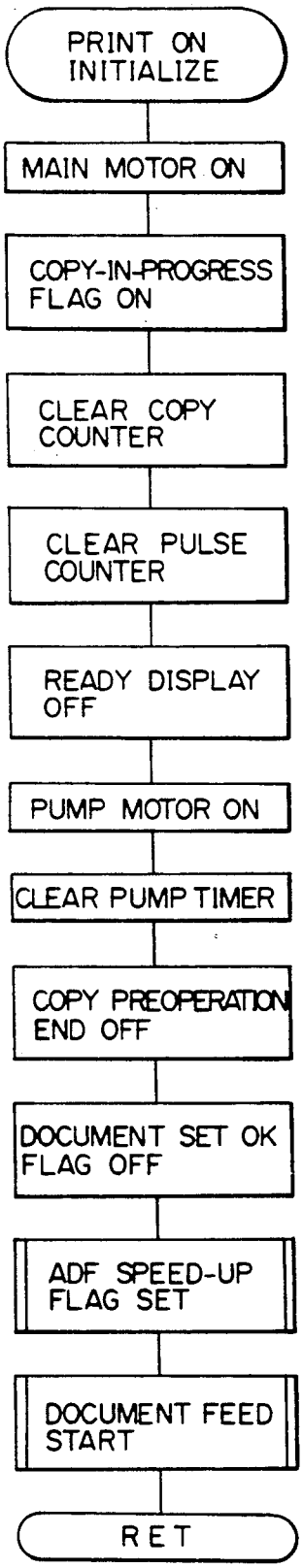
FIGS. 22 to 25 are flowcharts showing various subroutines included in the routine FIG. 21.

Referring to FIG. 21, the COPY PREPROCESS routine included in the basic routine of FIG. 4 is shown. Executed between the print-on and the actual copy routine, the PRECOPY PROCESS routine mainly consists of a PRINT-ON INITIALIZE subroutine and a COPY PREOPERATE subroutine. As shown in FIG. 22, the PRINT-ON INITIALIZE subroutine includes turning on the main motor 22 and a pump motor (not shown) adapted to feed the liquid developer, AND causing the ADF 2 to start feeding a document.

Figure 23:
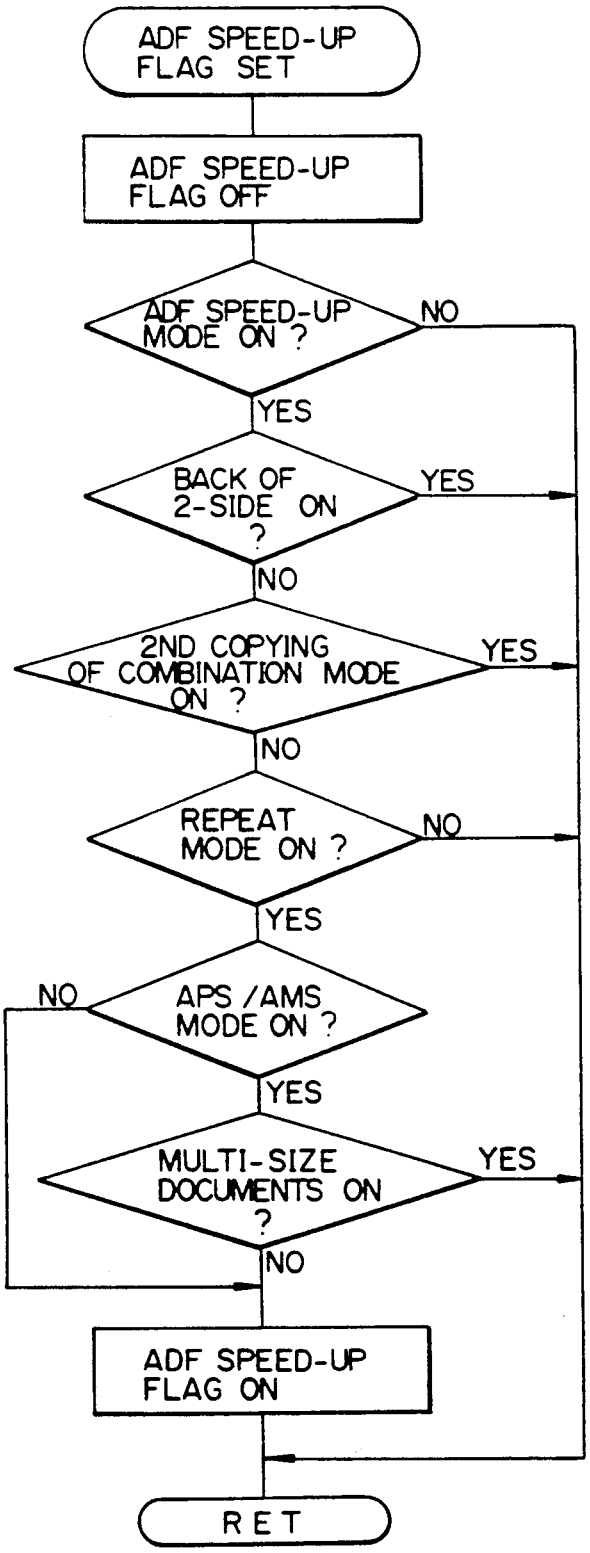

FIG. 23 shows ADF SPEED-UP FLAG SET processing included in the PRINT-ON INITIALIZE subroutine. This processing is to check various conditions such that, even when the ADF speed-up mode has been set up, the speed-up operation is inhibited unless the other conditions are satisfied. Here, the ADF speed-up mode is the precondition. In the two-sided copy mode, the ADF speed-up operation is not performed while the back of the paper sheet or one-sided copy 7 is imaged. This is because, should the document 14 jam the ADF 2, the paper sheet 7 refed from the intermediate tray 38 would simply turn out to be a waste copy and, moreover, the whole copying operation would have to be repeated again with the jammed document 14. For the same reason, the ADF speed-up operation is not performed during the second copying operation of the combination copy mode, i.e., when the paper sheet 7 is refed from the intermediate tray 38. Further, the ADF speed-up operation is inhibited when a repeat copy mode (set when a document fed for the first time is to be copied by REPEAT MODE CHECK processing which will be described) is not selected, i.e., when the first document 14 is fed from a stack of documents. This is because a misfeed in the ADF 2 ascribable to the inaccurate position of documents 14 or the failure of separation of documents 14 occurs more frequently with the first document 14 than with the others. The ADF speed-up operation is not performed in an APS-/AMS multiple size mode (APS/AMS mode with a stack of documents 14 having various sizes). Why the ADF speed-up operation is not performed in this mode is that in such a mode APS/AMS itself checks the size of the documents 14 in the event document feed and, therefore, has to check it document by document in the multiple size mode, i.e., the paper sheets 7 of a particular size have to be fed out depending upon the result of the checking.

Figure 24:
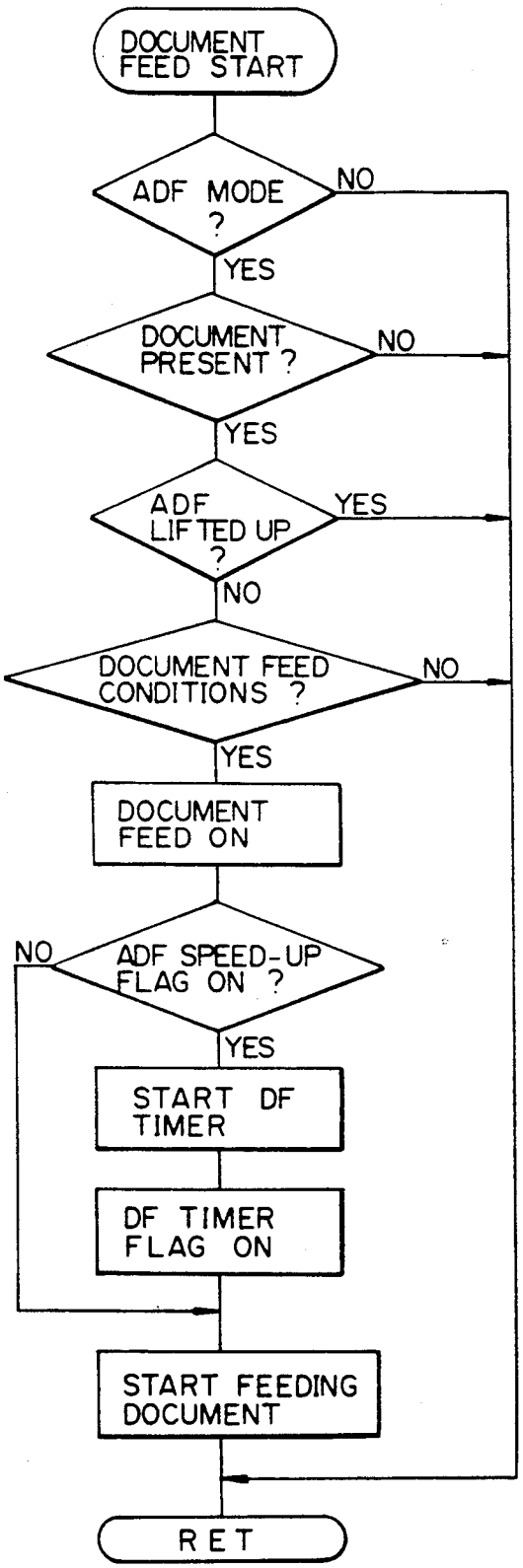

As shown in FIG. 24, a DOCUMENT FEED START subroutine included in the PRINT-ON INITIALIZE routine sets a document feed flag when the document feed conditions are satisfied (i.e. the ADF mode is set, the documents 4 are present, and the ADF 2 is not lifted up) and, if the ADF speed-up flag is set, starts a DF timer.

Figure 25:
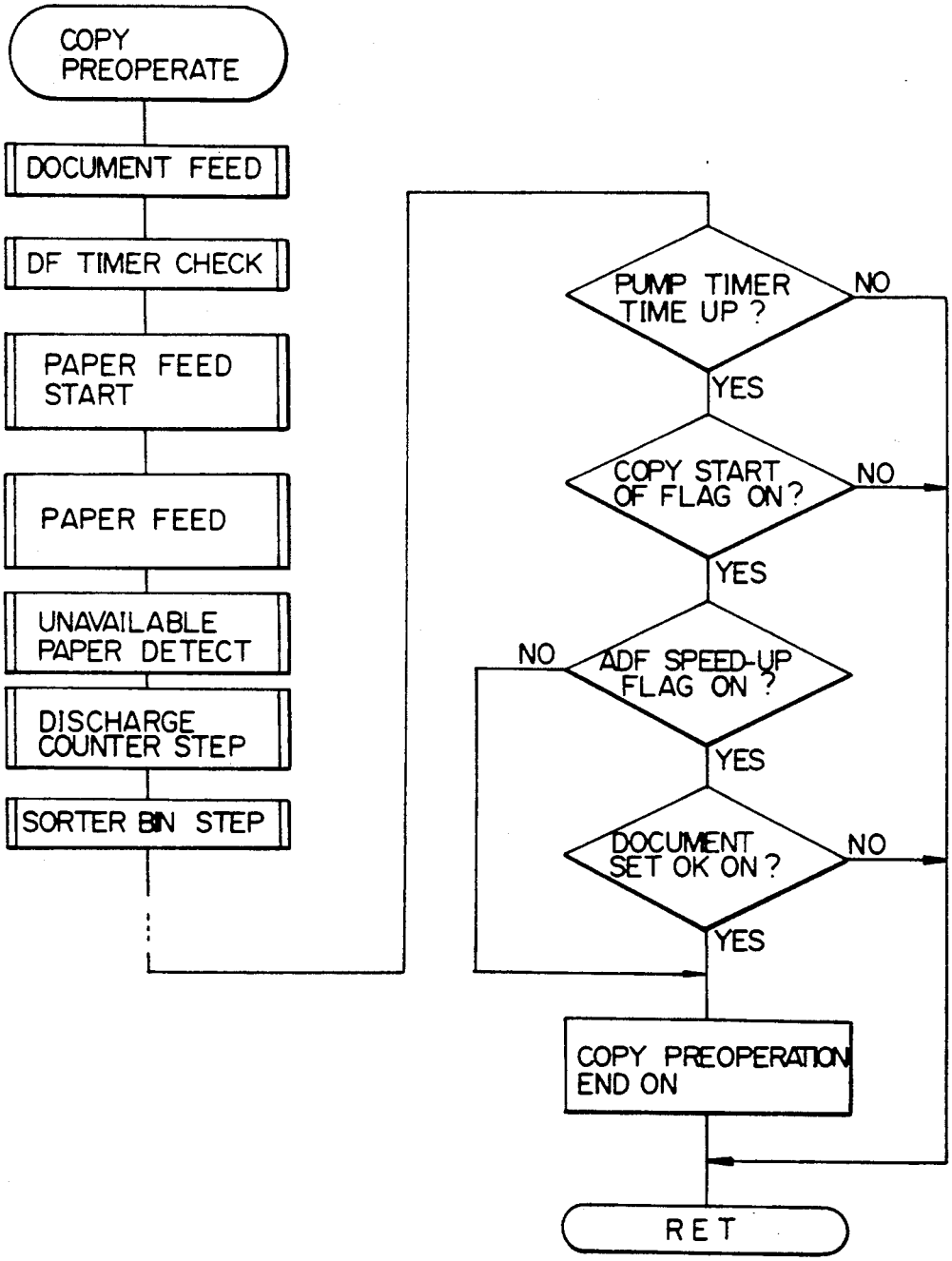
Figure 26:
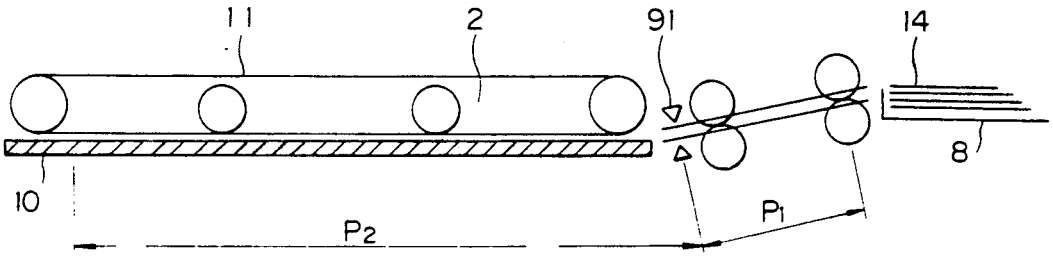
FIG. 26 is a schematic front view of an ADF and its associated sections of the copier.

FIG. 25 shows the COPY PREOPERATE subroutine included in the COPY PREPROCESS routine of FIG. 21. As shown, this subroutine mainly consists of document feed processing and paper feed processing. The ADF speed-up mode may be implemented by reducing the period of time allocated to the copy preoperation processing time. Specifically, two different systems are selectively executed: a document feed confirmation system (control system based on a first feed timing) wherein whether or not a document fed by the ADF 2 has jammed is determined and, only if it has not jammed, a paper sheet begins to be fed, and a speed-up system (control system based on a second feed timing) wherein a paper sheet begins to be fed without checking the ADF 2 for a jam. These systems will be described in sequence. It is to be noted that in the ADF 2 the reference number of pulses $P_1$ which appear during the interval between the feed of a document 14 from the document table 8 and its arrival at a reference sensor 91 is assumed to be seventy (one pulse is associated with 1 millimeter), and the reference number of pulses $P_2$ appearing during the interval between the movement of the document 14 away from the reference sensor 91 and its arrival at the predetermined position on the glass platen 10 is assumed to be 470, as shown in FIG. 26.

Figure 27:
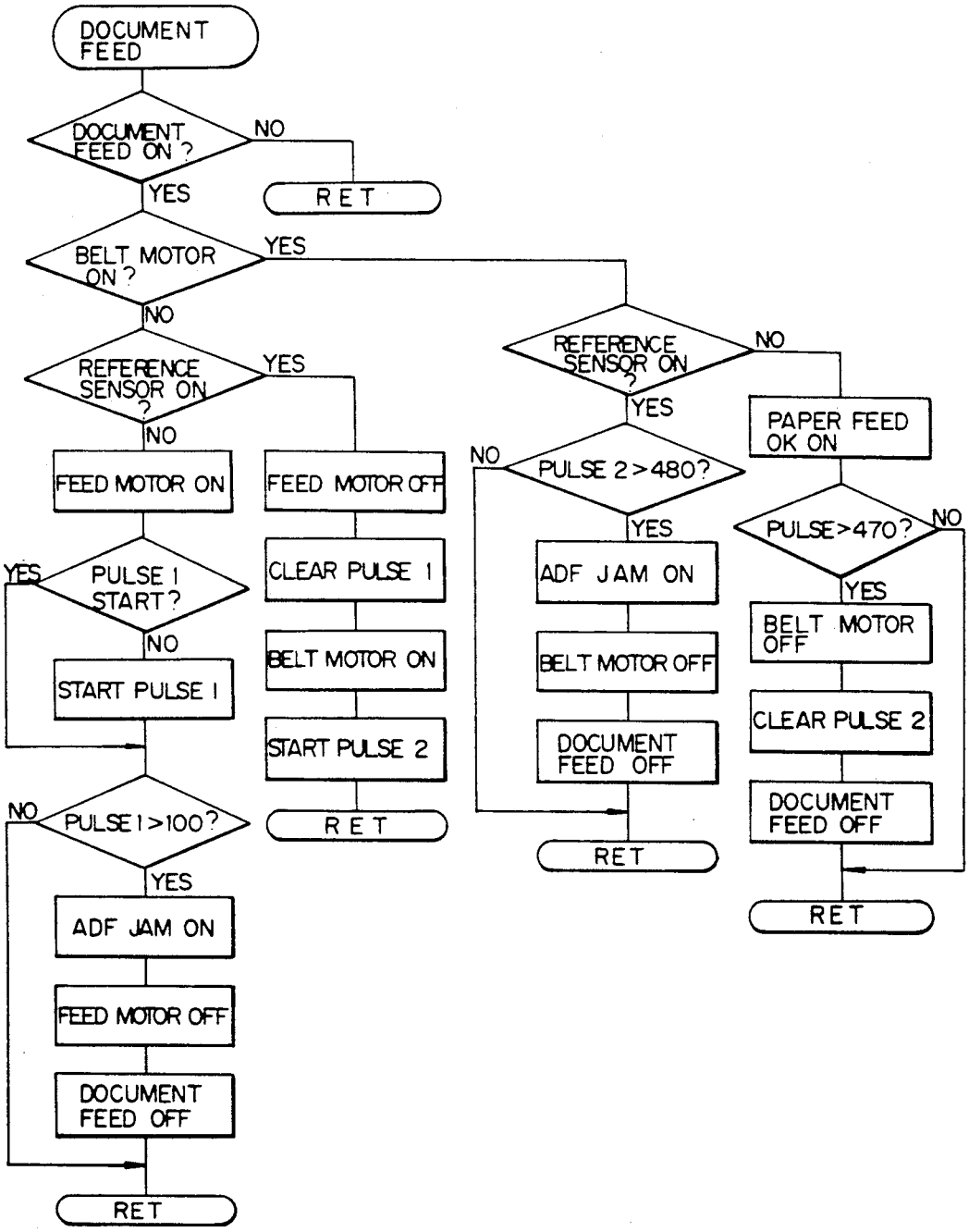
FIG. 27 is a flowchart showing a DOCUMENT FEED subroutine included in the routine of FIG. 21.
Figure 28:
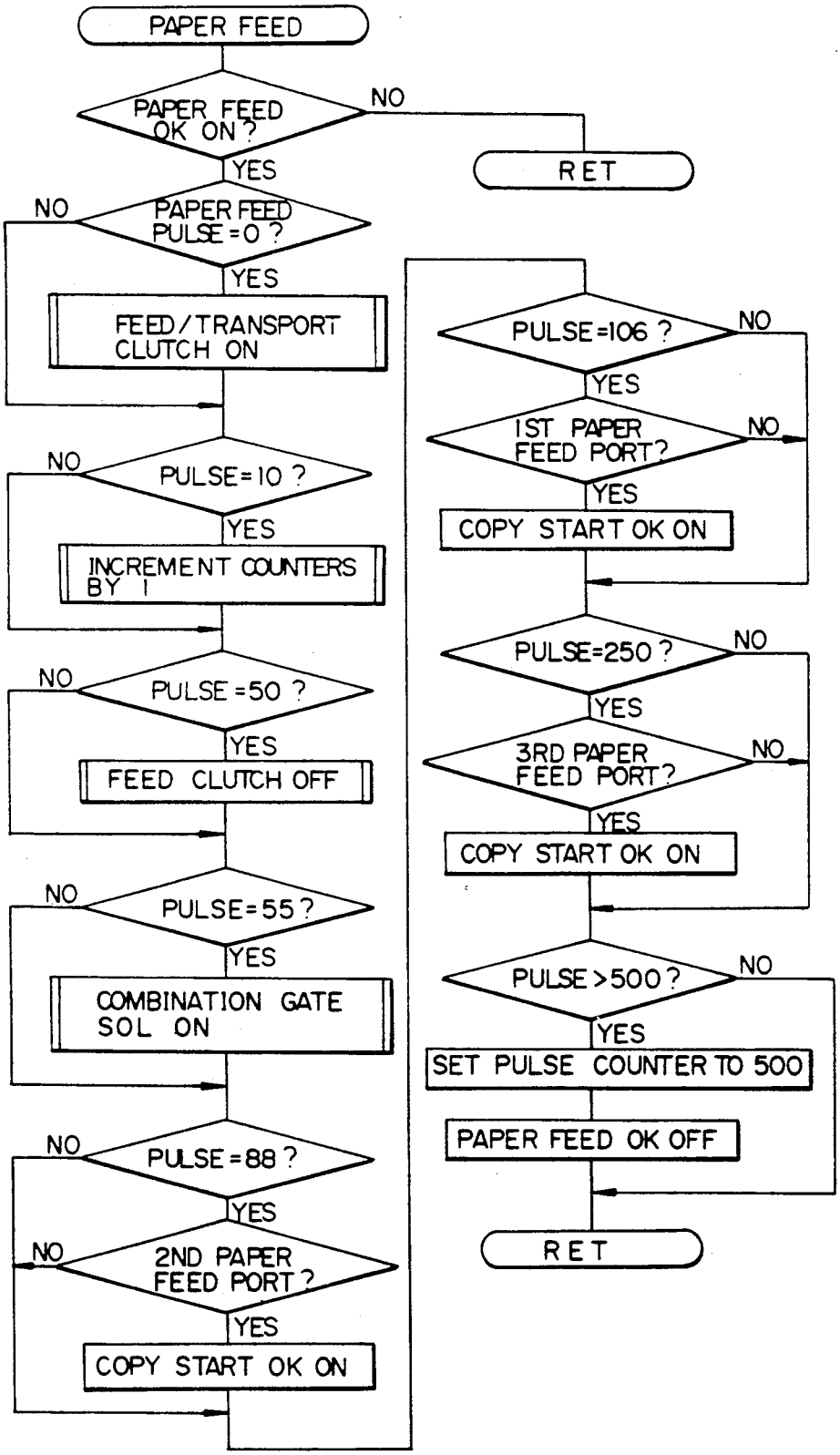
FIG. 28 is a flowchart showing a PAPER FEED subroutine also included in a COPY PREOPERATE routine.

First, in the document feed confirmation system, DOCUMENT FEED processing (shown in detail in FIG. 27) is executed so that after the leading edge of a document 14 fed by the ADF 2 has moved away from the reference sensor 91, the belt 11 is driven for a period of time associated with 470 pulses to bring the document 14 to the predetermined position on the glass platen 10. As the trailing edge of the document 14 being fed moves away from the reference sensor 91, a paper feed OK flag is set. A paper sheet 7 is fed only when this flag is set. Hence, when the document 14 fails to reach the reference sensor 91 or to leave the reference sensor 91 within a predetermined period of time as counted from the start of feed, the program decides that a jam or ADF misfeed has occurred. In this condition, the paper feed OK flag is not set to prevent a paper sheet 7 from being fed. If no misfeed is detected, the paper feed OK flag is set to start feeding a paper sheet 7 and this is followed by PAPER FEED processing shown in FIG. 28. Concerning the paper feed from the third paper feed port which requires the longest period of time, a copy start OK flag is set at the 250-th pulse (=0.86 seconds) as counted from the start of paper feed and then COPY PREOPERATION END is turned on to start on an actual copy routine. Assuming that the document feed speed is 500 millimeters per second and the document length (lateral) is 216 millimeters, the period of time between the start of the document feed and the end of the copy preoperation is produced with respect to the period of time between the start of document feed and the start of paper feed, as follows:

$$0.3+(70+216)/500=0.8 \text{ (second)}$$

In total, therefore, a period of time of 1.73 seconds is required including 0.86 second consumed from the time of the start of paper feed to the time of end of copy preoperation.

Figure 29:
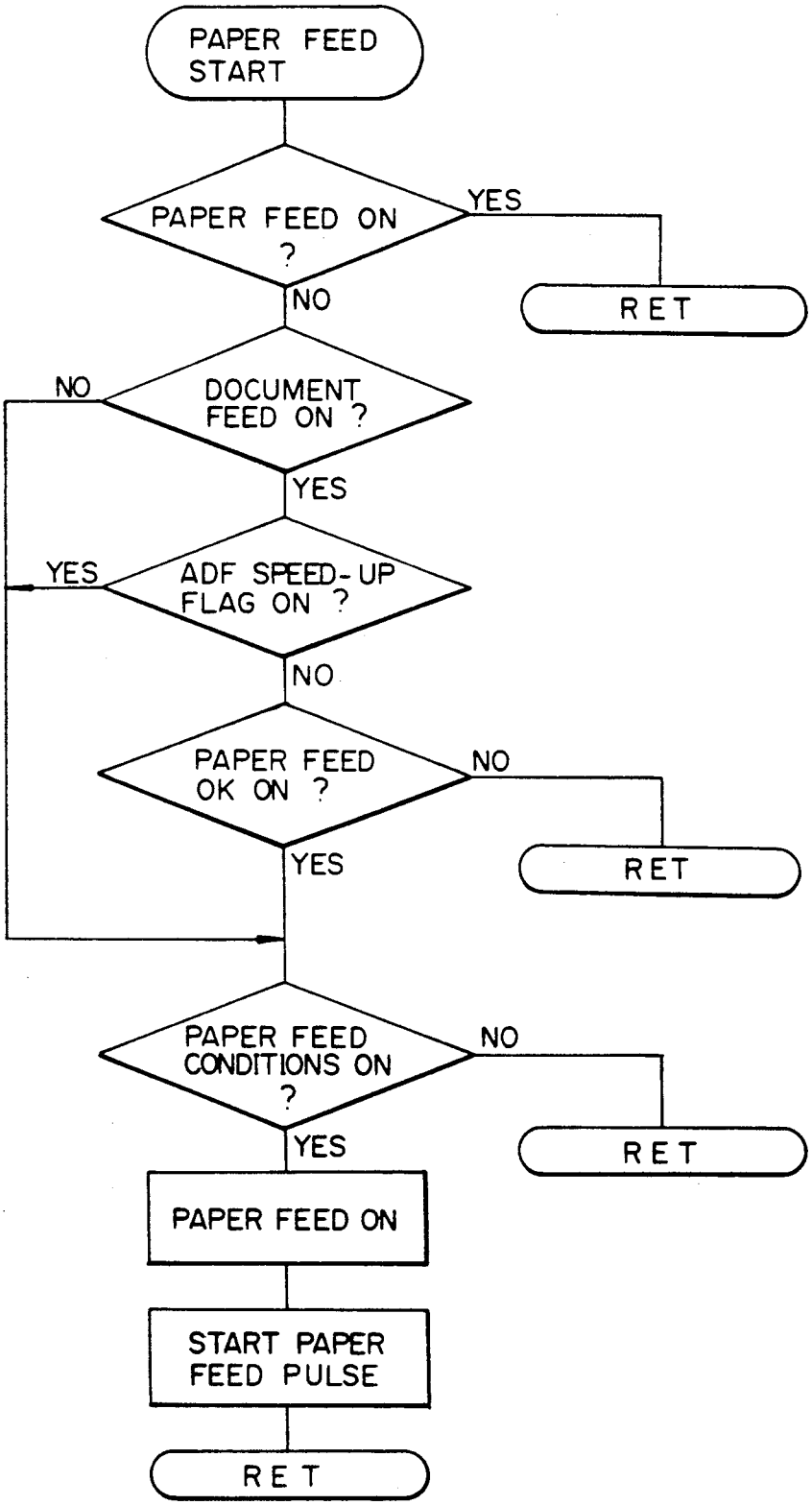
FIG. 29 is a flowchart showing a PAPER FEED START routine.
Figure 30:
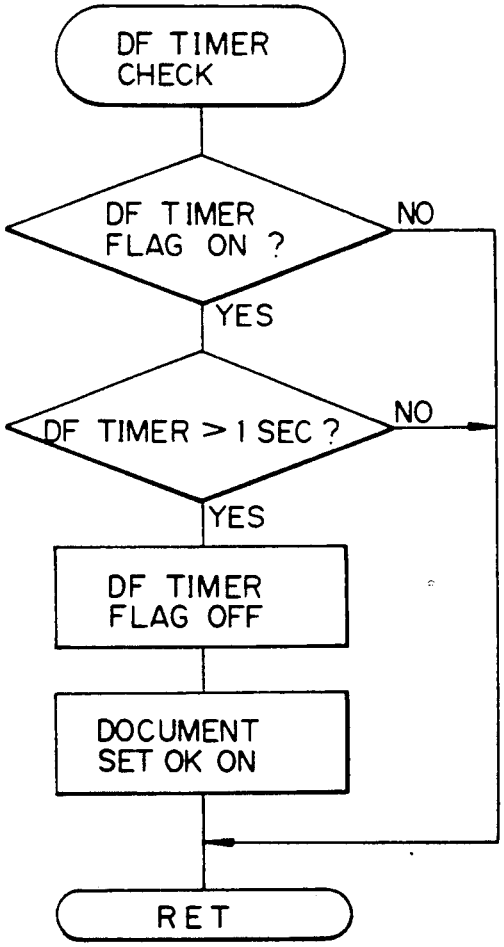
FIGS. 30 to 34 are flowcharts showing various subroutines included in the routinE of FIG. 28.

On the other hand, in the case of the speed-up system, a PAPER FEED START subroutine shown in FIG. 29 is executed. Specifically, whether the paper feed flag OK flag may be set or not, i.e., whether a misfeed has occurred in the ADF 2 or not, paper feed immediately begins if the other paper feed conditions are satisfied. Instead, a 1-second timer is started at the time of document feed (see DF TIMER CHECK shown in FIG. 30) and, upon the lapse of 1 second, a document set OK flag is set. Then, when both of the copy start OK flag and the document set flag OK flag are set by a document feed pulse (i.e. in 1 second after the start of document feed), the copy preoperation is completed. This means a decrease in the processing time by 0.73 second, compared to the document feed confirmation system. It follows that, when a single copy is to be produced with each of a great number of documents, a copying rate of 26 copies per minute is achievable with the speed-up system which is about 38% higher than the copying rate of 19 copies per minute particular to the document feed confirmation system.

Figure 31:
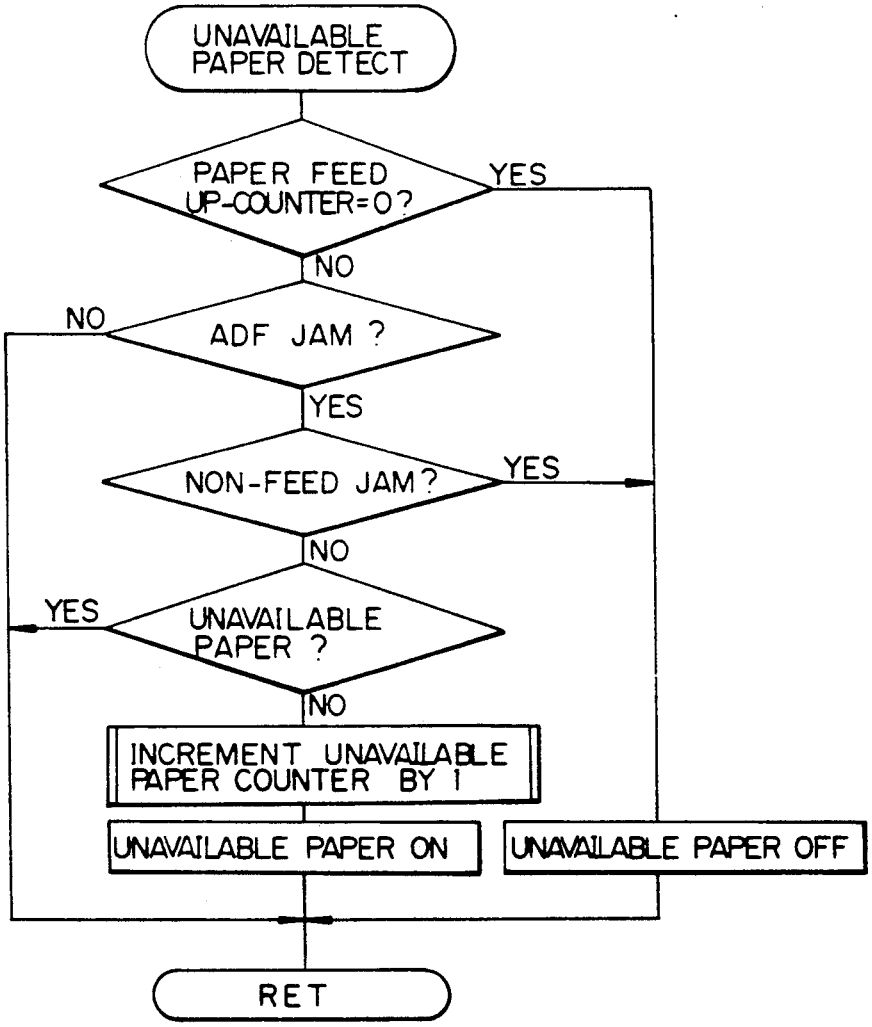

The COPY PREOPERATE processing includes an UNAVAILABLE PAPER DETECT procedure as shown in FIG. 31. When the document jams the ADF 2 after the start of feed of the paper sheet 7, the paper sheet 7 simply turns out to be a waste copy. The procedure of FIG. 31 is adapted to detect the presence of such an unavailable paper sheet. The occurrences of an unavailable paper sheets are counted up.

Figure 32:
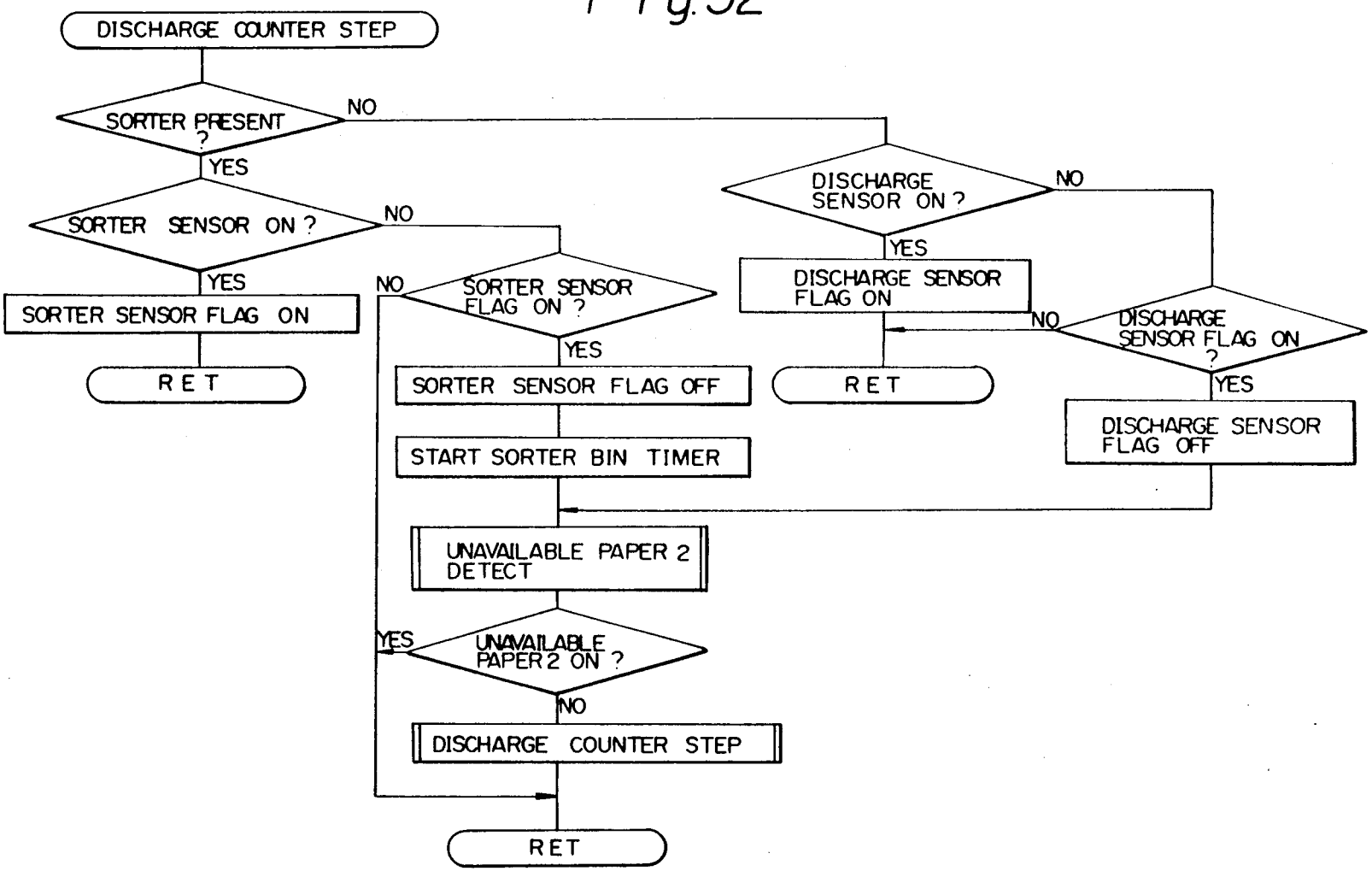
Figure 33:
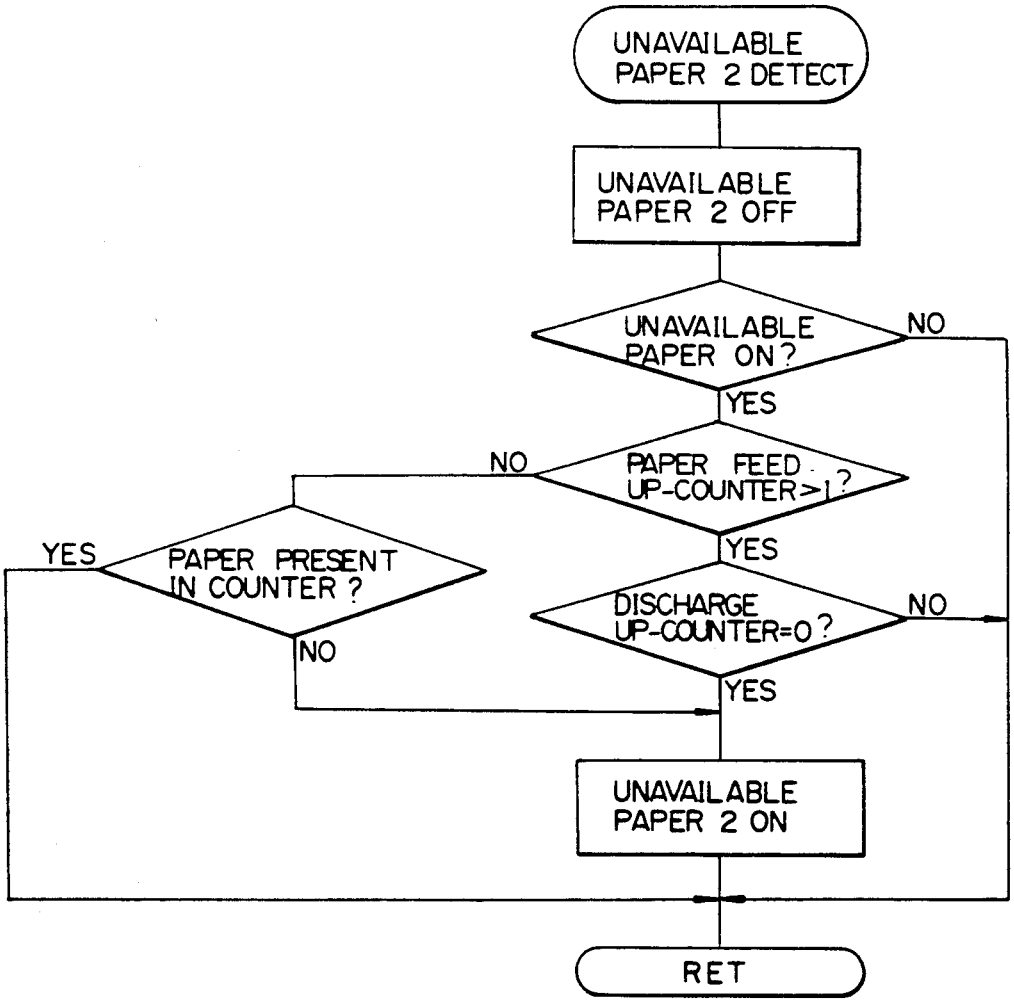
Figure 34:
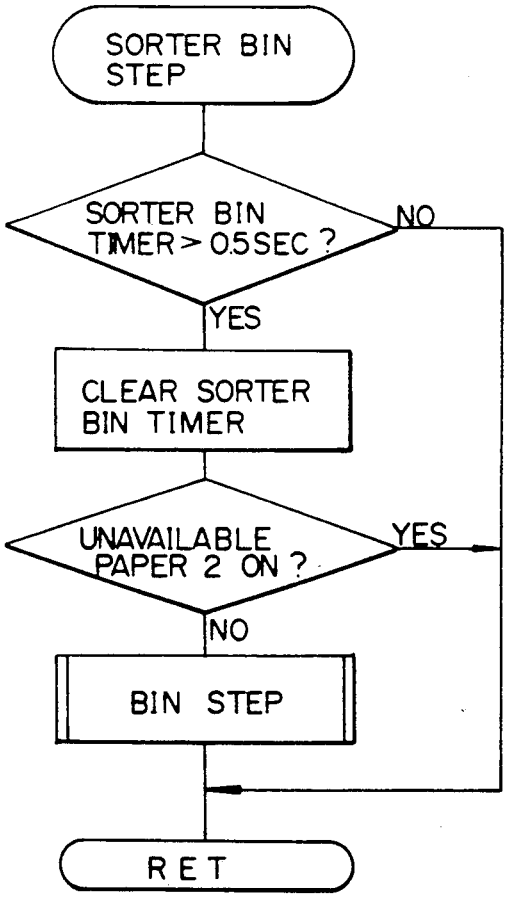

Further, whether or not the paper sheet 7 is unavailable is determined as it moves away from a final discharge sensor (not shown), as represented by an UNAVAILABLE PAPER 2 DETECT subroutine which forms a part of a DISCHARGE COUNTER STEP routine of FIG. 32. As shown in detail in FIG. 33, in this subroutine, if the paper sheet 7 being discharged is unavailable, a discharge counter is not incremented; and if the sorter 3 is used, the sorter bin is not incremented (see FIG. 34).

Figure 35:
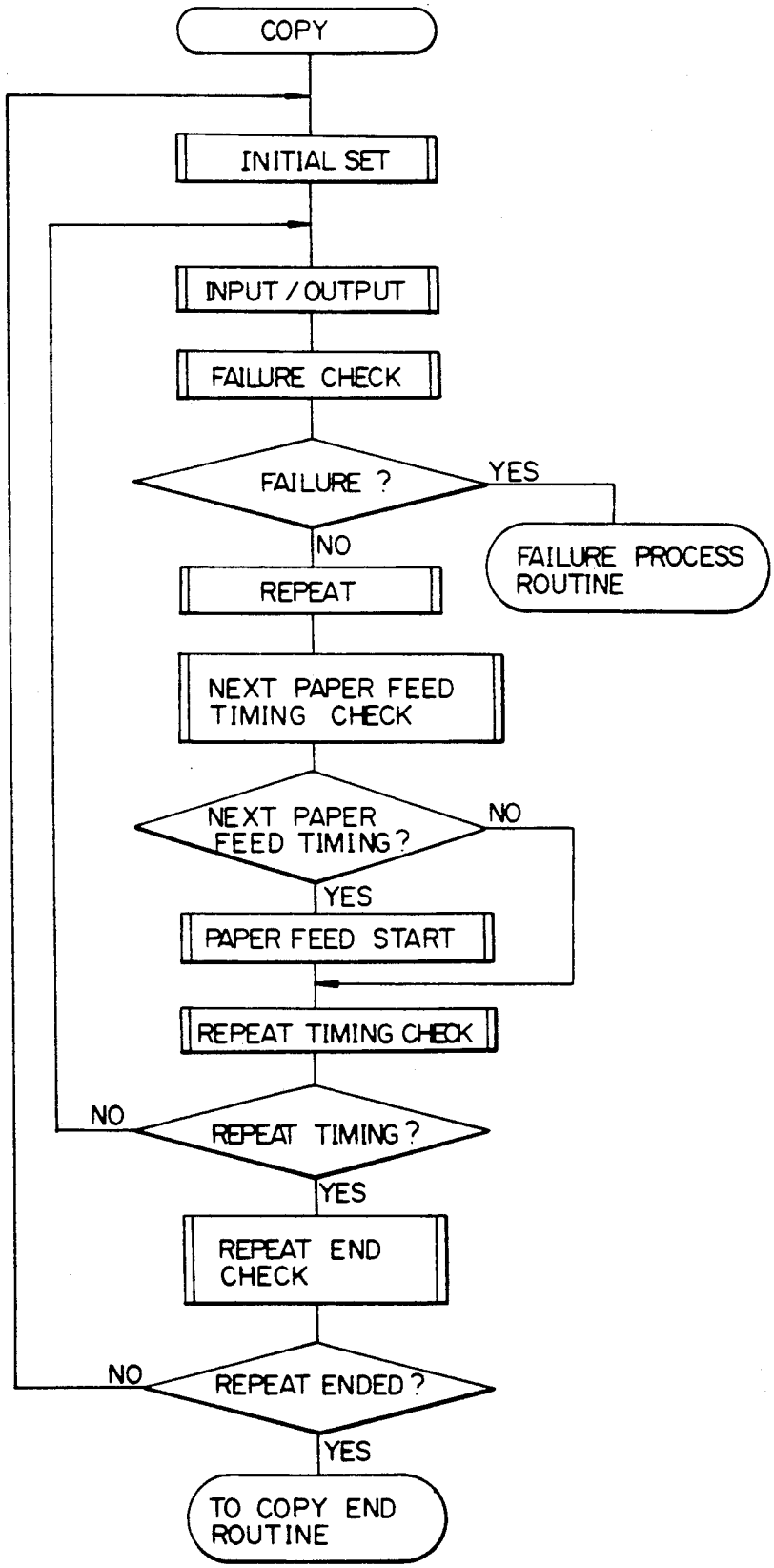
FIG. 35 is a flowchart showing a COPY routine.
Figure 40:
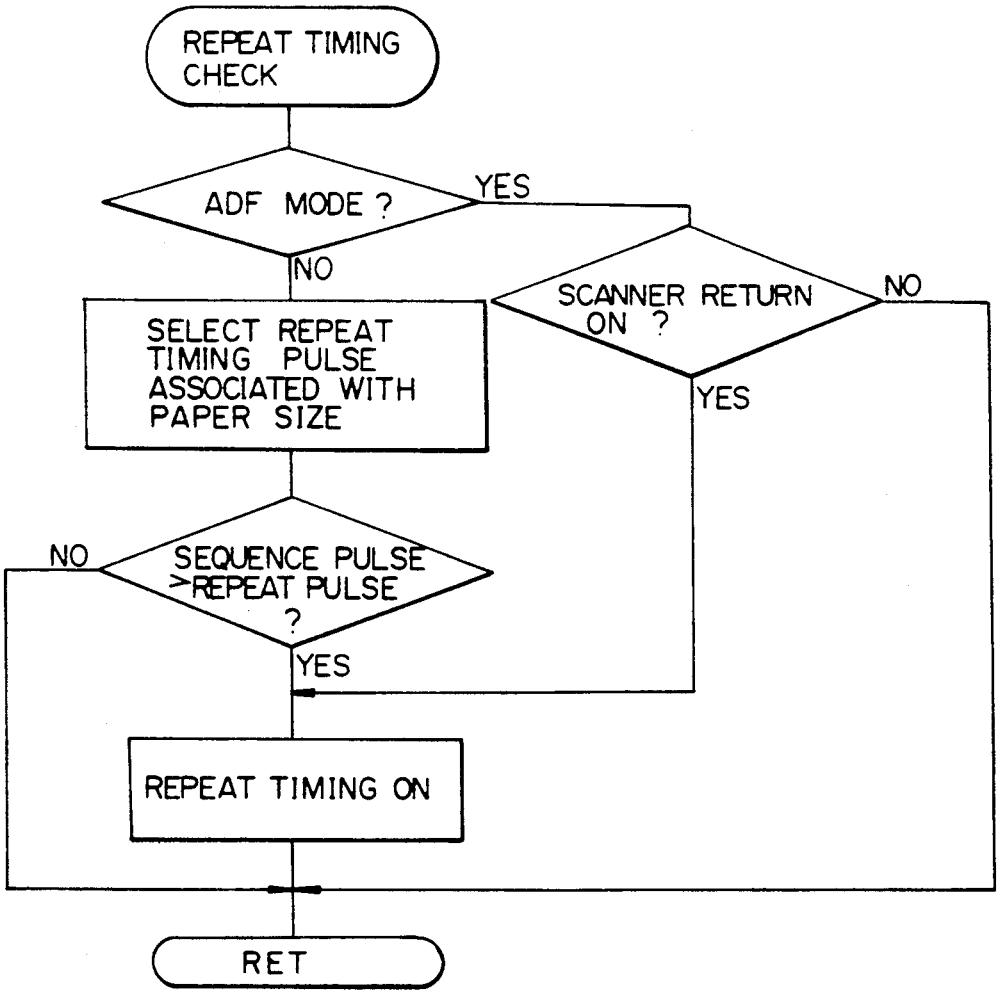
Figure 41:
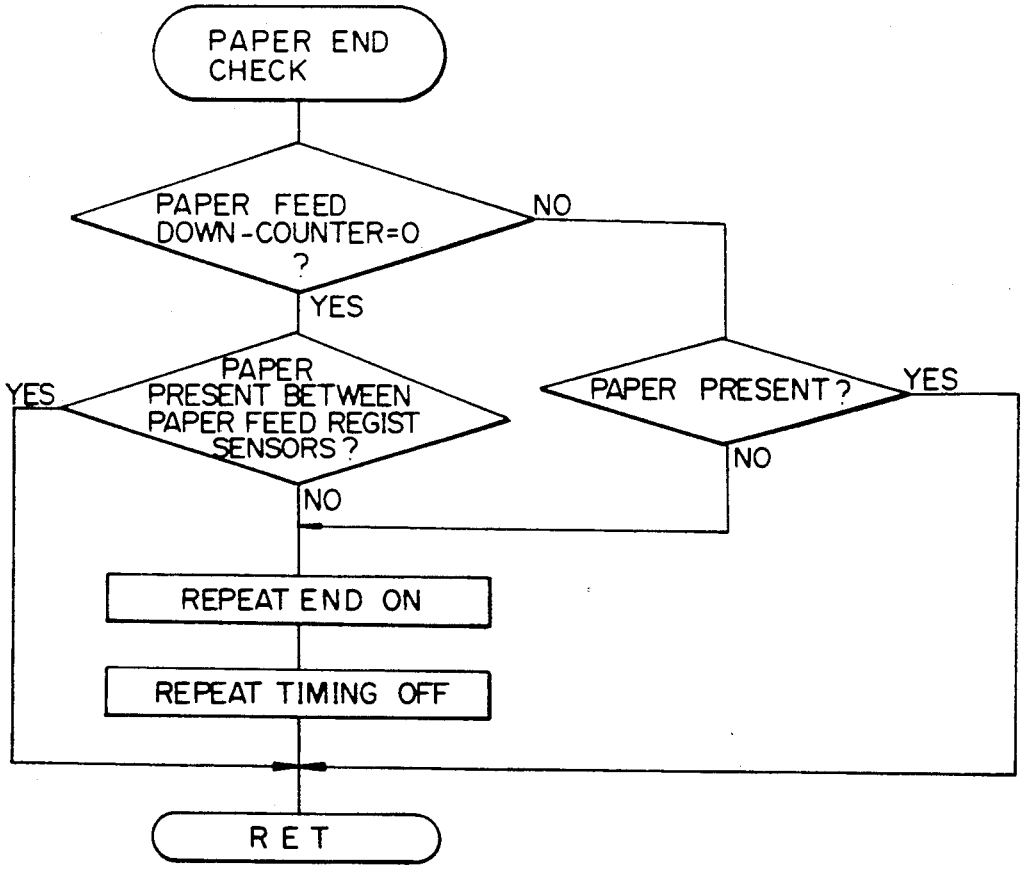

FIG. 35 shows a COPY routine which is included in the basic operation of FIG. 4. Major steps included in this routine are INITIAL SET (see FIGS. 36 and 37), REPEAT (see FIGS. 38 and 39), REPEAT TIMING CHECK (see FIG. 40), and REPEAT END CHECK (see FIG. 41).

Figure 36:
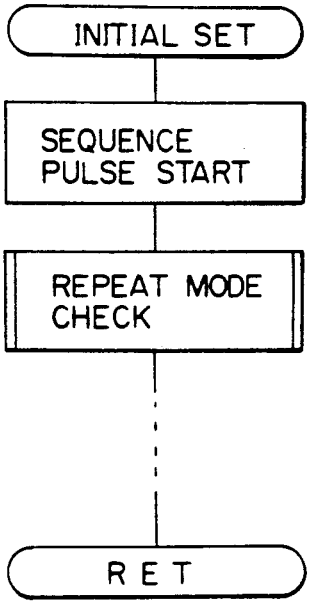
FIGS. 36 to 41 are flowcharts showing various subroutines included in the routine of FIG. 35.
Figure 37:
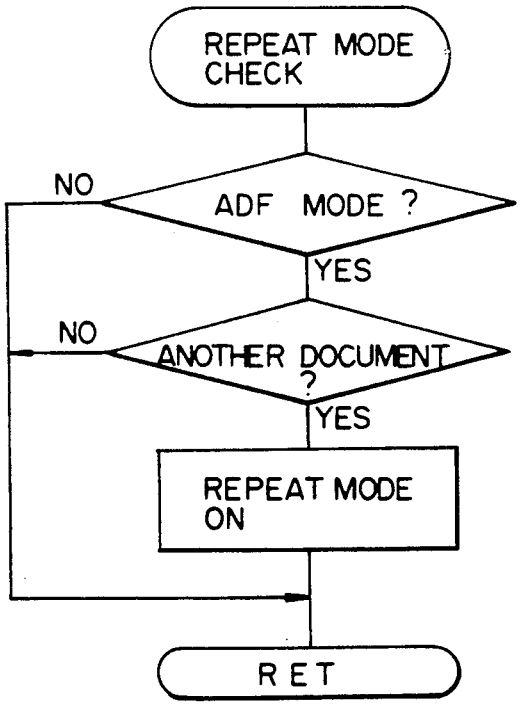

In the procedure shown in FIG. 36, the ADF 2 is checked for a repeat mode by a sequence of steps shown in FIG. 37. In FIG. 37, when the next document is set in an ADF mode, a repeat mode flag is set. The repeat mode flag causes the next document to be fed automatically at the end of copying so that the next copy may be copied without interruption. When the repeat mode flag is set in the PRINT-ON INITIALIZE processing, it is decided that a copying operation to occur is associated with any of the second and successive documents. This is used as one of the preconditions for setting the previously discussed speed-up flag.

Figure 38:
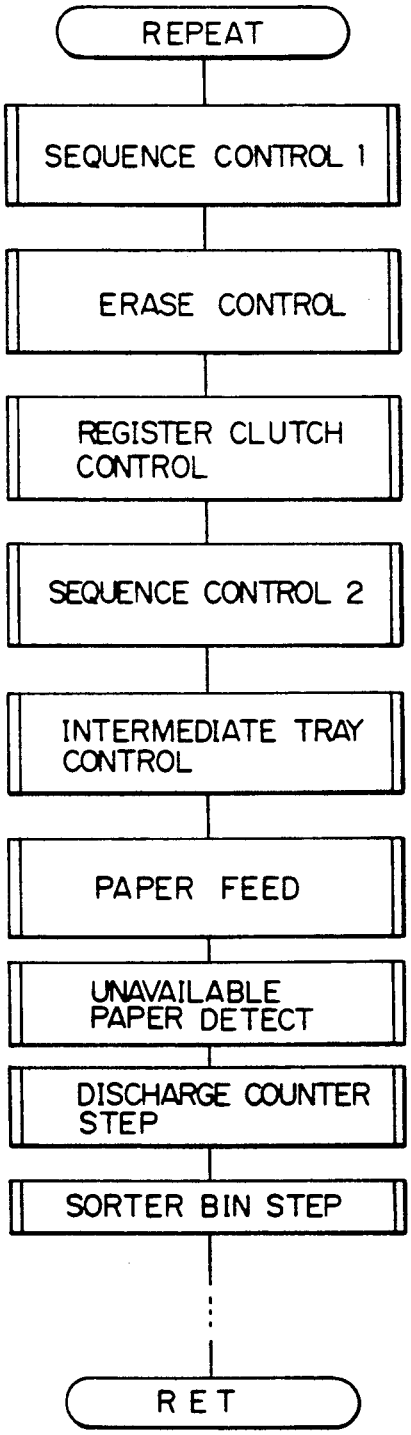
Figure 39:
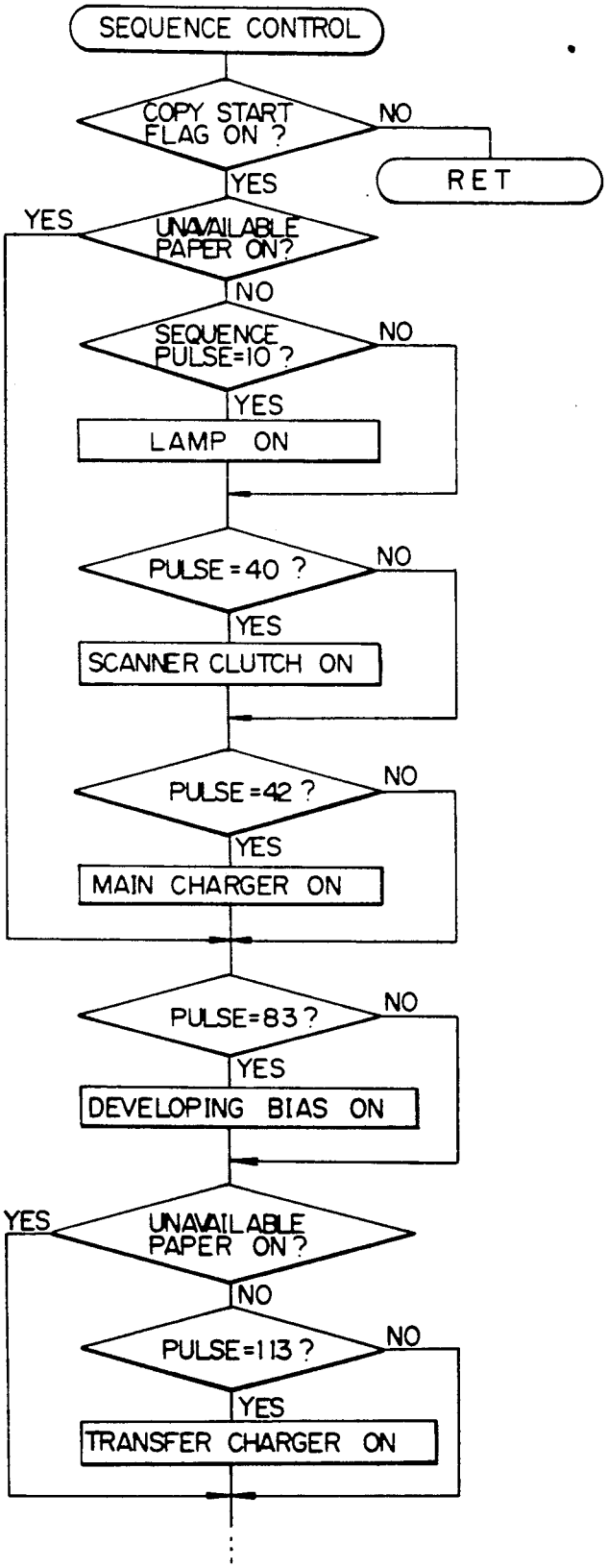

The REPEAT processing shown in FIG. 38 begins with SEQUENCE COTNROL processing for forming an image, as shown in FIG. 39. Specifically, turn-on control of the lamp 15, on-control of the scanner clutch, on-control of the main charger 2, on-control of the developing bias and other similar controls are performed on the basis of the value of sequence pulses. In this instance, when the unavailable paper flag is set indicating that the wasteful feed of a paper sheet has occurred, the program skips the above-mentioned image forming processing (although the developing bias is turned on) so that the waste paper sheet may be driven out of the copier as a simple black sheet which may be reused.

Figure 42:
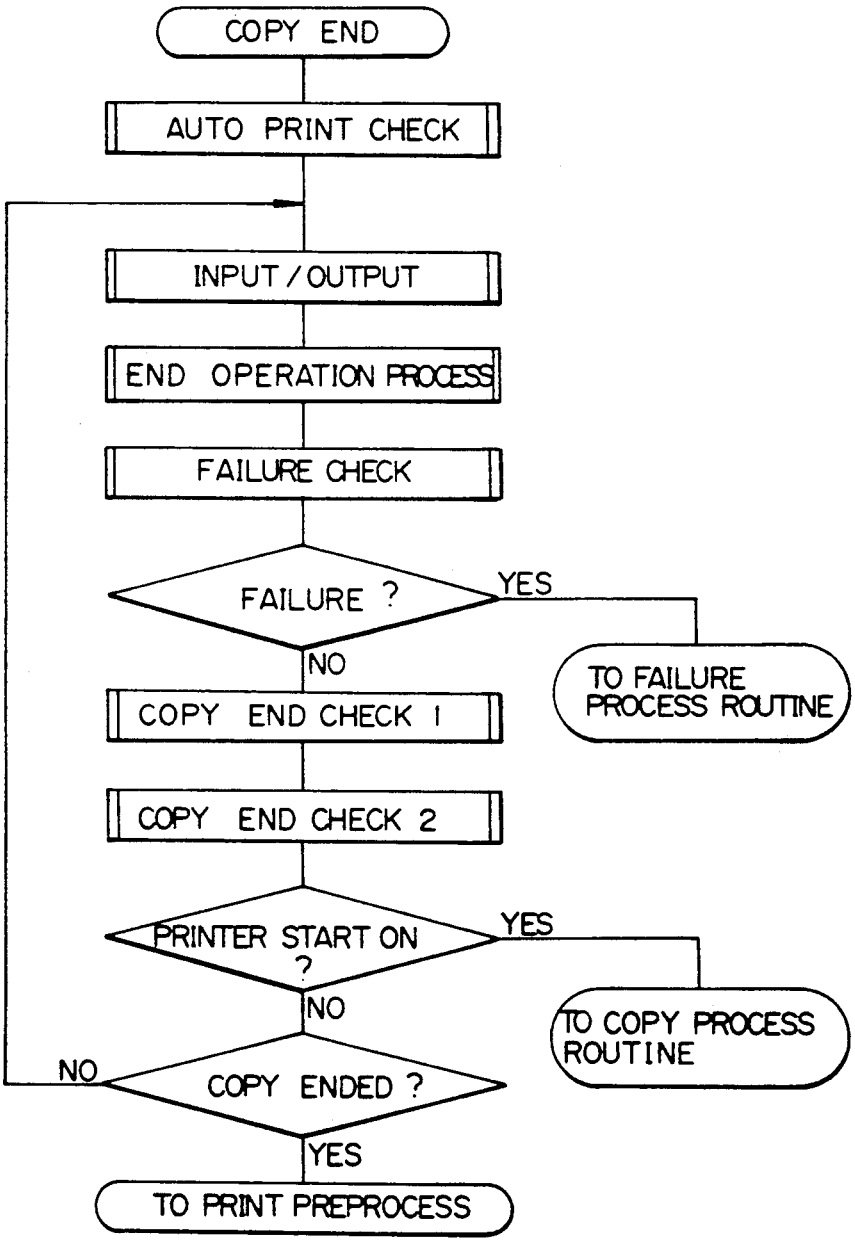
FIG. 42 is a flowchart showing a COPY END routine.
Figure 43:
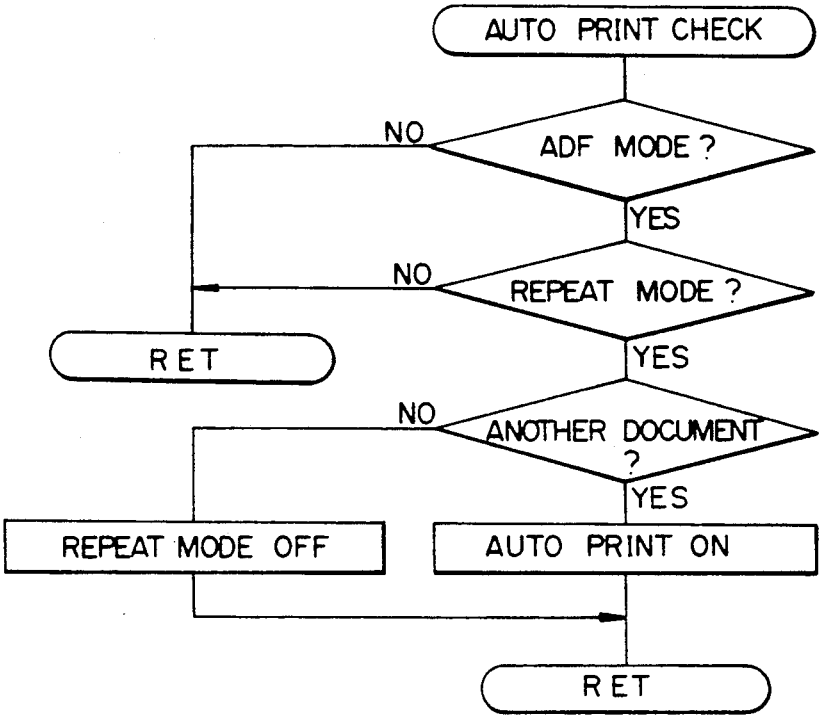
FIGS. 43 to 46 are flowcharts showing various subroutines included in the routine of FIG. 42.
Figure 44:
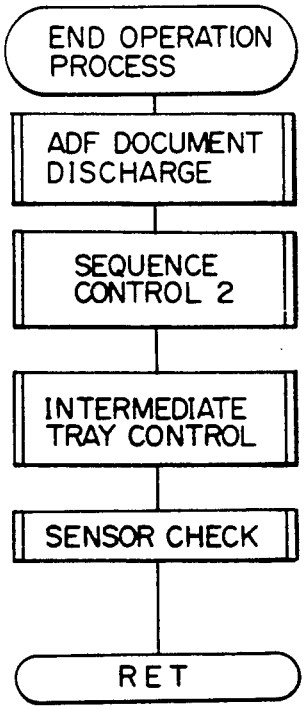
Figure 45:
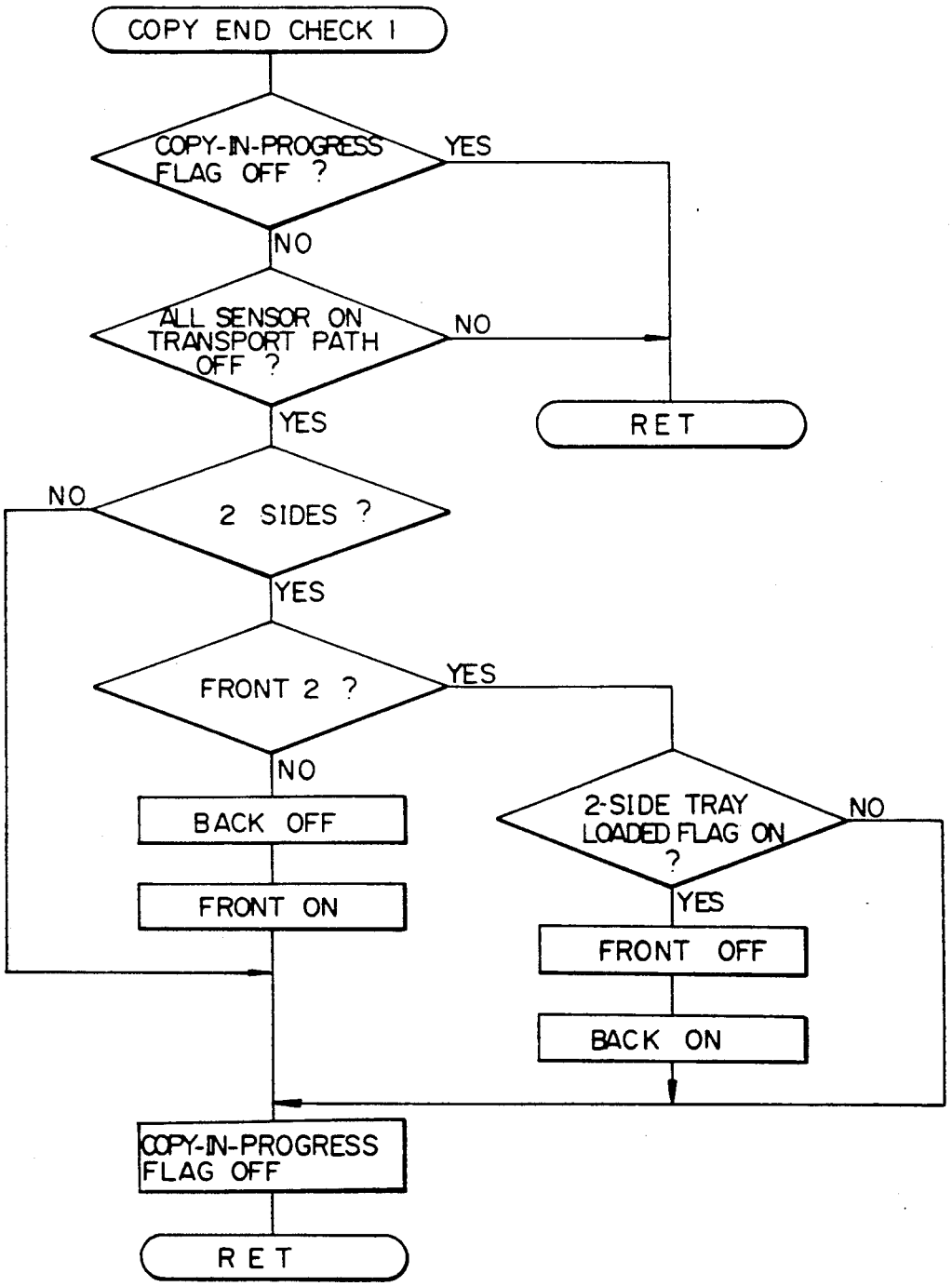
Figure 46:
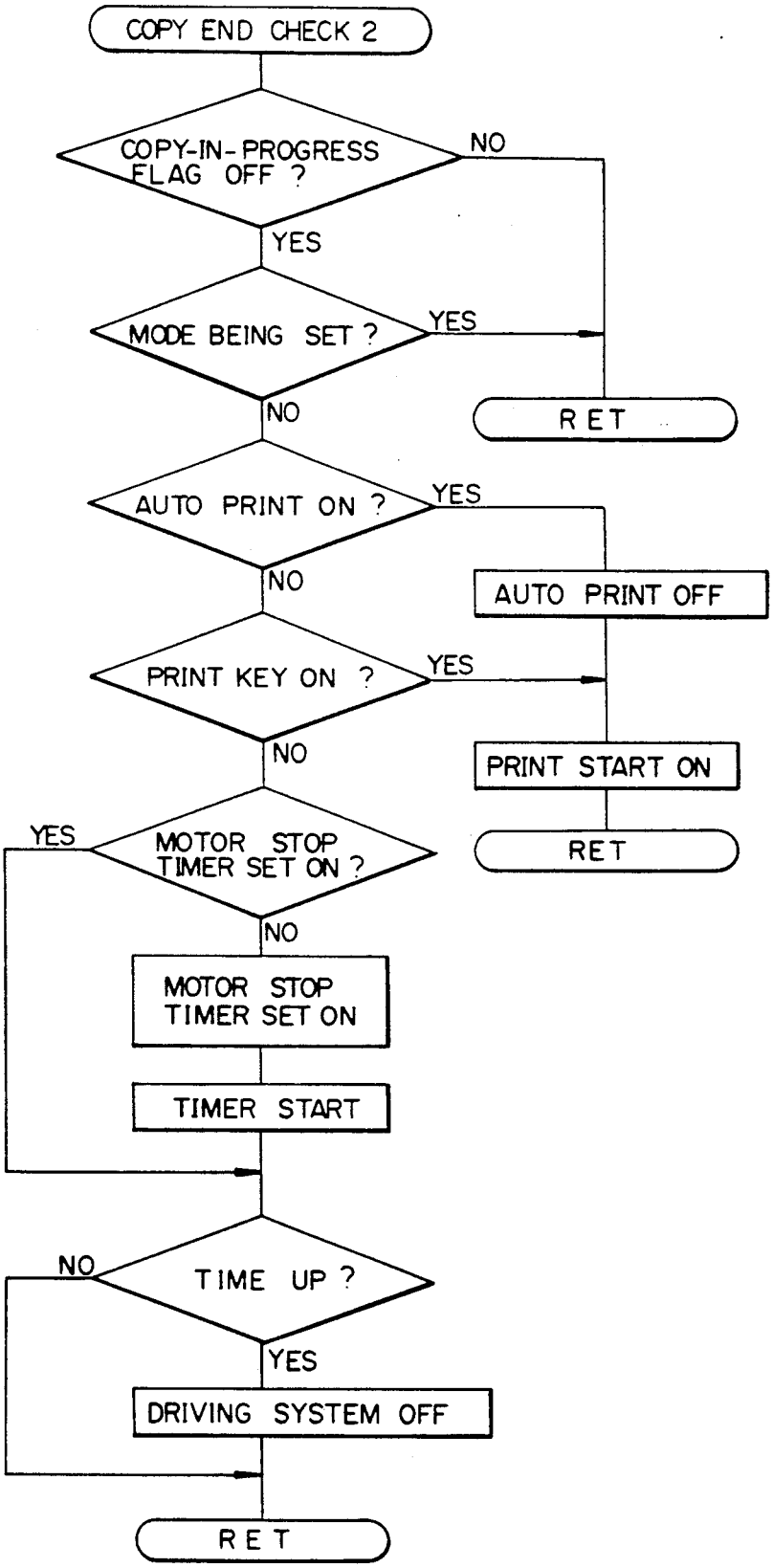

FIG. 42 shows the COPY END routine which mainly executes AUTO PRINT CHECK (see FIG. 43), OPERATION END (see FIG. 44), COPY END CHECK 1 (see FIG. 45), COPY END CHECK 2 (see FIG. 46); etc.

In summary, the present invention stems from the fact that when a stack of documents are sequentially fed by an ADF to be copied, a misfeed is apt to occur due mainly to inaccurate setting of the documents and mainly during the course of transport of the first document. In accordance with the present invention, while a paper sheet for copying the first document is fed at a first paper feed timing after checking the document feed condition, paper sheets associated with the second and successive documents are fed at a second paper feed timing without checking it. Hence, a waste copy is eliminated when the first document is fed and, yet, the copying time is reduced when the second document and onward are copied, taking full advantage of an ADF.

Various modifications will become possible for those skilled in the art after receiving the teachings of the present disclosure without departing from the scope thereof.

What is claimed is:

1. A paper feed control method for a copier which uses an automatic document feeder (ADF) for feeding and transporting a document to a glass platen and setting the document in a predetermined position on said glass platen, said method comprising the steps of:
   (a) feeding a paper sheet from paper feeding means regardless of a presence or absence of a misfeed of the document from said ADF; and
   (b) when the document associated with the paper sheet is misfed, executing predetermined processing by determining that the paper sheet is unavailable and said paper sheet is discharged.

2. A method as claimed in claim 1, wherein the processing comprises inhibiting an operation of a discharger counter which counts up paper sheets being discharged.

3. A method as claimed in claim 1, wherein the processing comprises inhibiting an operation of a sorter which is operatively connected to said copier.

4. A method as claimed in claim 1, wherein the processing comprises inhibiting an operation of image forming means of said copier.

5. A method as claimed in claim 4, wherein said operation of said image forming means comprises at least one of charging, illuminating for imagewise exposure and developing.

6. A method as claimed in claim 1, wherein a first paper feed timing and a second paper feed timing are predetermined for causing said paper feeding means to feed the paper sheet after confirming that the document has not been misfed by said ADF and for causing said paper feeding means to feed the paper immediately without confirming whether or not the document has been misfed, respectively, and the paper sheet is fed at the first paper feed timing for the first document to be copied and at the second paper feed timing for the second and successive documents to be copied.

7. A method as claimed in claim 6, wherein said copier has an intermediate tray for temporarily accommodating the paper sheet undergone a first copying operation and then refeeding the paper sheet for a second copying operation, and refeed of the paper sheet is effected at the first paper feed timing.

8. A paper feed control method for a copier which uses an automatic document feeder (ADF) for feeding and transporting a document to a glass platen and setting the document in a predetermined position on said glass platen, said method comprising the steps of:

(a) feeding a paper sheet from paper feeding means simultaneously with feeding the document from said ADF; and (b) when the document associated with the paper sheet is misfed, executing predetermined processing by determining that the paper sheet is unavailable and said paper sheet is discharged.

9. A method as claimed in claim 8, wherein the processing comprises inhibiting an operation of a discharge counter which counts up paper sheets being discharged.

10. A method as claimed in claim 8, wherein the processing comprises inhibiting an operation of a sorter which is operatively connected to said copier.

11. A method as claimed in claim 8, wherein the processing comprises inhibiting an operation of image forming means of said copier.

12. A method as claimed in claim 11, wherein said operation of said image forming means comprises at least one of charging, illuminating for imagewise exposure, and developing.

13. A method as claimed in claim 8, wherein a first paper feed timing and a second paper feed timing are predetermined for causing said paper feeding means to feed the paper sheet after confirming that the document has not been misfed by said ADF and for causing said paper feeding means to feed the paper immediately without confirming whether or not the document has been misfed, respectively, and the paper sheet is fed at the first paper feed timing for the first document to be copied and at the second paper feed timing for the second and successive documents to be copied.

14. A method as claimed in claim 13, when said copier has an intermediate tray for temporarily accommodating the paper sheet undegone a first copying operation and then refeeding the paper sheet for a second copying operation, and refeed of the paper sheet is effected at the first paper feed timing.

15. In a paper feed control method for a copier which uses an automatic document feeder (ADF) for feeding and transporting a document to a glass platen and setting the document in a predetermined position on said glass platen, the improvement wherein a paper sheet is fed from paper feeding means simultaneously with feeding the document from said ADF and, when the document associated with the paper sheet is misfed, executing predetermined processing by determining that the paper sheet is unavailable, and wherein a first paper feed timing and a second paper feed timing are predetermined for causing said paper feeding means to feed the paper sheet after confirming that the document has not been misfed by said ADF and for causing said paper feeding means to feed the paper immediately without confirming whether or not the document has been misfed, respectively, and the paper sheet is fed at the first paper feed timing for the first document to be copied and at the second paper feed timing for the second and successive documents to be copied.

16. In a paper feed control method for a copier which uses an ADF for feeding and transporting a document to a predetermined position on a glass platen and causes paper feeding means to feed a paper sheet to copy the document, the improvement wherein a first paper feed timing and a second paper feed timing are predetermined for causing said paper feeding means to feed the paper sheet after confirming that the document has not been misfed by said ADF and for causing said paper feeding means to feed the paper immediately without confirming whether or not the document has been misfed, respectively, and the paper sheet is fed at the first paper feed timing for the first document to be copied and at the second paper feed timing for the second and successive documents to be copied.

17. A method as claimed in claim 16, wherein said copier has an intermediate tray for temporarily accommodating the paper sheet undergone a first copying operation and then refeeding the paper sheet for a second copying operation, and refeed of the paper sheet is effected at the first paper feed timing.

18. A method as claimed in claim 16, wherein when the document has been misfed by said ADF, predetermined processing is executed by determining that the paper sheet already fed is unavailable.

19. A method as claimed in claim 18, wherein the processing comprises inhibiting an operation of a discharge counter which counts up paper sheets being discharged.

20. A method as claimed in claim 18, wherein the processing comprises inhibiting an operation of a sorter which is operatively connected to said copier.

21. A method as claimed in claim 18, wherein the processing comprises inhibiting an operation of image forming means of said copier.

22. A method as claimed in claim 21, wherein said operation of said image forming means comprises at least one of charging, illuminating for imagewise exposure, and developing.

* * * * *

UNITED STATES PATENT AND TRADEMARK OFFICE

CERTIFICATE OF CORRECTION

PATENT NO. : 5,142,323

DATED : August 25, 1992

INVENTOR(S) : Minoru Iwamoto

It is certified that error appears in the above-identified patent and that said Letters Patent is hereby corrected as shown below:

On the title page, Item [75]: Inventor: should be, --Minoru Iwamoto--.

Signed and Sealed this

Twelfth Day of October, 1993

*Attest:*

*Attesting Officer*

BRUCE LEHMAN

*Commissioner of Patents and Trademarks*